US007217501B2

(12) United States Patent
Kawauchi et al.

(10) Patent No.: US 7,217,501 B2
(45) Date of Patent: May 15, 2007

(54) INFRARED-SENSITIVE LITHOGRAPHIC PRINTING PLATE

(75) Inventors: Ikuo Kawauchi, Shizuoka (JP); Ippei Nakamura, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/743,412

(22) Filed: Dec. 23, 2003

(65) Prior Publication Data

US 2004/0137365 A1 Jul. 15, 2004

(30) Foreign Application Priority Data

Dec. 27, 2002 (JP) ..... P. 2002-382230

(51) Int. Cl.
*G03C 1/00* (2006.01)

(52) U.S. Cl. ..... 430/286.1; 430/270.1

(58) Field of Classification Search ..... 430/270.1, 430/281.1, 283.1, 286.1, 288.1, 302
See application file for complete search history.

(56) References Cited

U.S. PATENT DOCUMENTS 6,143,464 A * 11/2000 Kawauchi ..... 430/270.1
6,340,551 B1 * 1/2002 Miyake et al. ..... 430/192
6,517,987 B2 * 2/2003 Fujita et al. ..... 430/165
6,573,022 B1 * 6/2003 Miyake et al. ..... 430/270.1

FOREIGN PATENT DOCUMENTS

| | | | |
|---|---|---|---|
| EP | 0 909 657 | A2 * | 4/1999 |
| EP | 1 176 467 | A1 | 1/2002 |
| EP | 1 204 000 | A1 | 5/2002 |
| EP | 1 211 065 | A2 | 6/2002 |
| EP | 1 219 464 | A2 | 7/2002 |
| EP | 1 258 369 | A2 | 11/2002 |
| JP | 7-285275 | A | 10/1995 |

OTHER PUBLICATIONS

European Search Report dated Sep. 24, 2004.

* cited by examiner

*Primary Examiner*—Barbara L. Gilliam
(74) *Attorney, Agent, or Firm*—Sughrue Mion, PLLC

(57) ABSTRACT

There is provided an infrared-sensitive lithographic printing plate capable of direct plate-making based on digital data from a computer or the like, and excellent in development latitude and scratch resistance, which is an infrared-sensitive lithographic printing plate comprising a support and a heat-sensitive layer, the heat-sensitive layer comprising (A) a copolymer having a specific monomer unit having a carboxyl group, (B) an alkali-soluble high molecular weight compound having a sulfonamide group, and (C) a light-heat conversion material.

11 Claims, No Drawings

INFRARED-SENSITIVE LITHOGRAPHIC PRINTING PLATE

FIELD OF THE INVENTION

The present invention relates to a photosensitive lithographic printing plate. More particularly, it relates to an infrared-sensitive lithographic printing plate for so-called direct plate-making, which is capable of recording based on digital image signal formed by a computer through an infrared laser light for direct plate-making. It most particularly relates to an infrared-sensitive lithographic printing plate which has a wide development latitude, and is excellent in scratch resistance.

BACKGROUND OF THE INVENTION

The recent development of a laser is remarkable. Particularly, for solid lasers/semiconductor lasers having an emission region over a near infrared region to an infrared region, high-output and compact apparatuses have become readily available. The infrared-sensitive lithographic printing plate for direct plate-making based on digital data from a computer or the like using such an infrared laser as a light source can be handled in a bright room, and it is very preferable in terms of plate-making operation.

As the infrared-sensitive lithographic printing plate for direct plate-making, there is known a negative type planographic printing master plate containing an infrared absorber, a compound generating an acid by heat (acid generator), a crosslinking agent which effects a crosslinking reaction by an acid, and a binder polymer. However, the negative type planographic printing master plate requires heating after exposure for effecting a crosslinking reaction. This results in the increase in number of steps, leading to a complicated process, and in addition, entails the problem of high energy consumption.

For this reason, as a planographic printing master plate for an infrared laser not requiring heating after exposure, there was proposed a positive type infrared-sensitive lithographic printing plate having a recording layer containing an alkali aqueous solution-soluble binder resin, and an infrared absorber (such as an infrared absorbing dye) for absorbing light and generating heat. For the positive type photosensitive lithographic printing plate, in the unexposed portions (image portions), the infrared absorbing dye, or the like serves as a dissolution inhibitor which interacts with the binder resin to substantially reduce the solubility of the binder resin. In the exposed portions (non-image portions), the interaction between the infrared absorbing dye or the like, and the binder resin is weakened by heat generated through light exposure. As a result, the exposed portions become soluble in an alkali developer. Development is carried out by utilizing the difference in solubility between the exposed portions and the unexposed portions, resulting in the formation of a lithographic printing plate.

However, it cannot yet be said that the difference in solubility in a developer of the unexposed portions (image portions) and the solubility of the exposed portions (non-image portions) under various working conditions is sufficient. Unfavorably, the overdevelopment (the film reducing phenomenon that the image portions also begin to dissolve, thereby thinning an image film), and the insufficient development (the film remaining phenomenon that the non-image portions cannot completely dissolve, and are left behind) due to the variations in working conditions tend to occur. Further, an image recording layer also receives minute scratches by being touched on the surface during handling, or by other causes because of its low strength. Thus, and in other ways, it tends to undergo variations in surface conditions. Also when such minute scratches or slight surface variations occur, the solubility of the peripheral portion thereof increases. Accordingly, the unexposed portions (image portions) dissolve during development, unfavorably resulting in scratch marks, which cause the degradation of the plate wear resistance, and the inferior ink receptibility.

Such a problem derives from the essential difference in plate-making mechanism between the infrared-sensitive lithographic printing plate and the photosensitive lithographic printing plate for plate-making through UV exposure. Namely, the photosensitive lithographic printing plate for plate-making through UV exposure contains an alkali aqueous solution-soluble binder resin, and an onium salt and quinone diazide compounds as essential components. The onium salt and the quinone diazide compounds not only serve as dissolution inhibitors by the interaction with the binder resin at the unexposed portions (image portions), but also are decomposed by light to generate an acid, and serve as dissolution accelerators at the exposed portions (non-image portions), and thus play the two roles.

In contrast, the infrared absorbing dye in the infrared-sensitive lithographic printing plate only serves as a dissolution inhibitor at the unexposed portions (image portions), and will not accelerate the dissolution at the exposed portions (non-image portions). Therefore, when, as a binder resin, the one having a high solubility in an alkali developer is used previously for making a difference in solubility between at the unexposed portions and at the exposed portions, unfavorably, film reduction occurs, the scratch resistance is reduced, the conditions before development become instable, and other problems occur. On the other hand, when the solubility of the binder resin in an alkali developer is reduced in order to strengthen the unexposed portions, the reduction in sensitivity is caused. This restricts the range of the development conditions under which the discriminability between the image portions and the non-image portions can be kept (referred to as development latitude).

For this reason, various studies have been made on the development of selective dissolution inhibitors whereby the dissolution inhibition ceases at the exposed portions, and the dissolution inhibition is kept at the unexposed portions. For example, JP-A-7-285275 or the like discloses the following technique. To a recording layer of a positive type lithographic printing plate material for an infrared layer, a light-heat converting agent, and a substance which is heat decomposable, and substantially reduces the solubility of an alkali-soluble resin in a thermally undecomposed state are added. As a result, the solubility of the recording layer is inhibited, and the scratch resistance is improved. On the other hand, at the exposed portions, the substance is decomposed by the heat converted by the light-heat converting agent, and loses its action of inhibiting the dissolution of the alkali-soluble resin, which allows the improvement of the sensitivity.

However, even with the foregoing technique, the development latitude and the scratch resistance cannot be yet said to be sufficient, and have been under the circumstances where a further improvement is required.

SUMMARY OF THE INVENTION

It is therefore an object of the invention to overcome the deficiency in the prior art associated with a so-called photosensitive lithographic printing plate for direct plate-making, capable of direct plate-making based on, particularly, digital data from a computer or the like, for an infrared laser. Specifically, it is an object of the invention to provide an infrared-sensitive lithographic printing plate excellent in development latitude and scratch resistance.

It was possible to solve the foregoing problem of the invention by the following means.

1. An infrared-sensitive lithographic printing plate comprising a support and a heat-sensitive layer, whrerein the heat-sensitive layer comprises: (A) a copolymer having a monomer unit represented by the following formula (I); (B) an alkali-soluble high molecular weight compound having a sulfonamide group; and (C) a light-heat conversion material:

Formula (I):

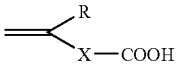

wherein R represents a hydrogen atom or an alkyl group; X represents an arylene group which may have a substituent, or any of the following structures:

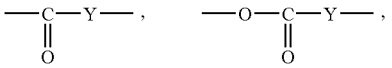

—Ar—Y— wherein Ar represents an arylene group which may have a substituent; Y represents a divalent connecting group.

2. The infrared-sensitive lithographic printing plate according to the item 1, wherein the copolymer (A) comprises the monomer unit represented by formula (I) in an amount of 1 to 90 mol %

3. The infrared-sensitive lithographic printing plate according to the item 1, wherein the copolymer (A) further has at least one monomer unit of (meth)acrylic acid esters, (meth)acrylamide derivatives and styrene derivatives.

4. The infrared-sensitive lithographic printing plate according to the item 1, wherein the copolymer (A) further has at least one monomer unit of (meth)acrylic acid esters, (meth)acrylamide derivatives and styrene derivatives in an amount of 5 to 90 mol %.

5. The infrared-sensitive lithographic printing plate according to the item 1, wherein the heat-sensitive layer comprises the copolymer (A) in an amount of 1 wt % to 40 wt %.

6. The infrared-sensitive lithographic printing plate according to the item 1, wherein the alkali-soluble high molecular weight compound (B) has at least one monomer unit of low molecular weight compounds each having in one molecule, at least one sulfonamide group —NH—$SO_2$— and at least one polymerizable unsaturated bond.

7. The infrared-sensitive lithographic printing plate according to the item 1, wherein the heat-sensitive layer further comprises novolak resin.

8. The infrared-sensitive lithographic printing plate according to the item 1, wherein the light-heat conversion material is an infrared absorbing dye.

9. The infrared-sensitive lithographic printing plate according to the item 8, wherein the infrared absorbing dye has an absorbance at 700 to 1200 nm infrared rays.

10. The infrared-sensitive lithographic printing plate according to the item 1, wherein the heat-sensitive layer comprises the light-heat conversion material in an amount of 0.01 to 50 wt %.

DETAILED DESCRIPTION OF THE INVENTION

An infrared-sensitive lithographic printing plate of the invention is characterized by including: a support; and a heat-sensitive layer on the support, the heat-sensitive layer containing (A) a copolymer having a monomer unit represented by the following formula (I), (B) an alkali-soluble high molecular weight compound having a sulfonamide group, and (C) a light-heat conversion material. Below, each element of the infrared-sensitive lithographic printing plate of the invention will be described in details.

[Copolymer Having a Monomer Unit Represented by the Formula (I)]

Formula (I):

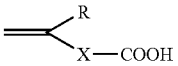

In the formula (I), R denotes a hydrogen atom or an alkyl group. It is preferably a hydrogen atom or an alkyl group having 1 to 4 carbon atoms. X denotes an arylene group which may have a substituent, or any of the following structures.

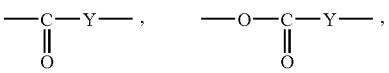

—AR—Y— wherein Ar denotes an arylene group which may have a substituent; and Y denotes a divalent connecting group.

As the divalent connecting group represented by Y, mention may be made of an alkylene group, an arylene group, an imide group, and an alkoxy group, which may also have substituents. As the substituents, mention may be made of an alkyl group, a hydroxyl group, an alkoxy group, a halogen atom, a phenyl group, a dimethyl amino group, an ethylene oxide group, a vinyl group, an o-carboxybenzoyloxy group, and the like.

R is preferably a methyl group. X and Ar each is preferably the following group:

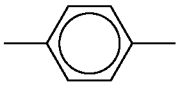

Y is preferably —O-Z- or —NH-Z- (Z represents a divalent connecting group).

Below, specific examples of the monomer represented by the formula (I) will be shown. However, the invention is not limited thereto.

a-1
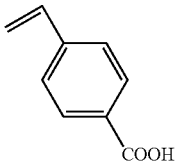
a-2
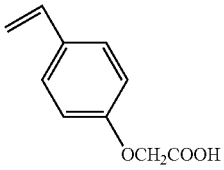
a-3
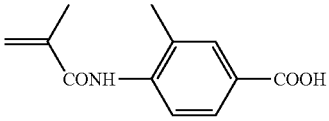
a-4
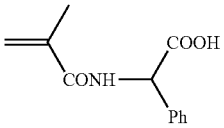
a-5
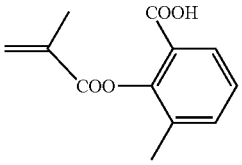
a-6
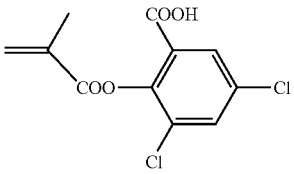
a-7
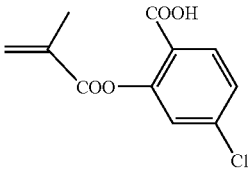
a-8
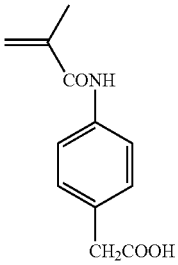
-continued
a-9
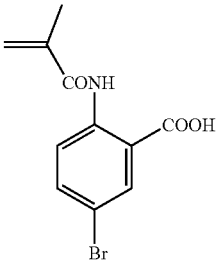
a-10
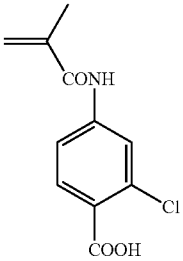
a-11
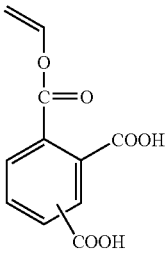
a-12
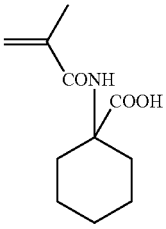
a-13
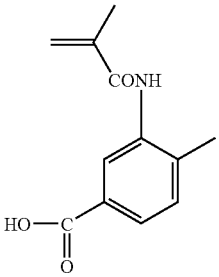

-continued a-14,15

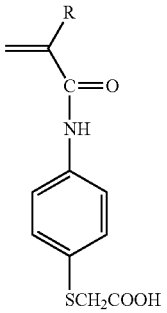

a-14: R = —H, a-15: R = —$CH_3$ a-16

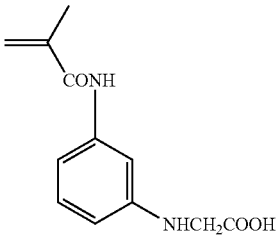

a-17

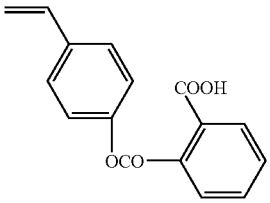

a-18,19,20

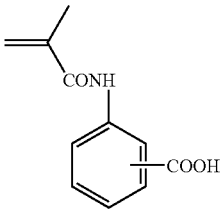

a-18: o-
a-19: m-
a-20: p-a-21

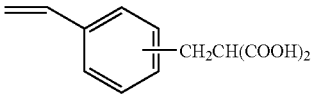

a-22,23,24

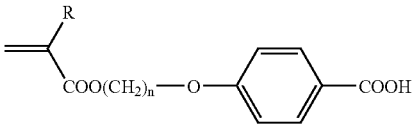

a-22: R = CH3, n = 4
a-23: R = CH3, n = 6
a-24: R = H, n = 6 a-25

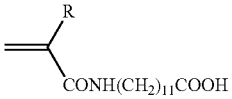

a-26

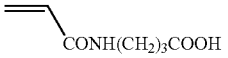

-continued a-27

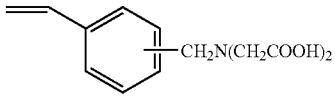

a-28

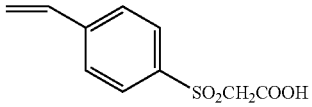

a-29

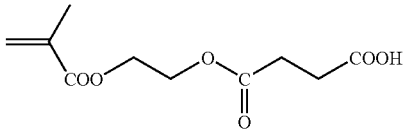

a-30

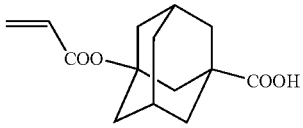

a-31

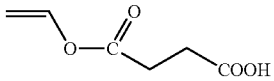

a-32

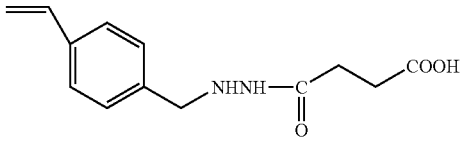

a-33

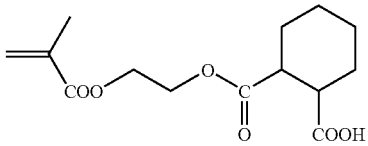

a-34

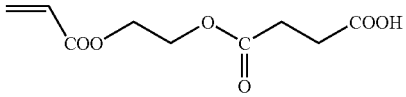

a-35

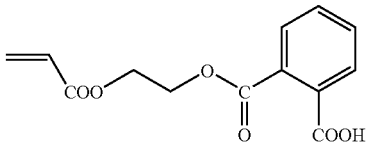

a-36

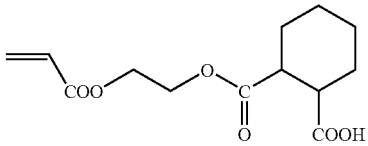

The content of the monomer represented by the formula (I) in the copolymer is preferably 1 to 90 mol %, more preferably 2 to 50 mol %, and further preferably 5 to 30 mol %. When it falls within the foregoing range, favorable developability and residual film ratio of the unexposed portions can be obtained.

As the copolymerizable monomer components which are copolymerized with the monomers represented by the formula (I) to form copolymers, mention may be made of (meth) acrylic acid esters, (meth)acrylamide derivatives, and styrene derivatives. The copolymerizable monomer components may comprise one selected from (meth)acrylic acid esters, (meth)acrylamide derivatives, and styrene derivatives, may comprise any two of these, or may comprise three or more thereof. Namely, for example, the components may comprise a total of four of two selected from (meth)acrylic acid esters and two selected from styrene derivatives.

Incidentally, in this specification, acryl and methacryl are collectively referred to as (meth)acryl. By the wording "as the copolymerizable components, (meth)acrylic acid esters are included", it is meant that at least any of acrylic acid esters and methacrylic acid esters is included. The same goes for the (meth)acrylamide derivatives.

The (meth)acrylic acid ester of the copolymerizable monomer component is a substituted or unsubstituted alkyl ester, aryl ester, or the like. Examples of the alkyl group may include methyl, ethyl, n-propyl, isopropyl, n-butyl, isobutyl, t-butyl, n-hexyl, n-heptyl, n-octyl, and 2-ethylhexyl. Whereas, examples of the aryl group may include phenyl, 1-naphthyl, 2-naphthyl, and benzyl. The alkyl group or the aryl group may also be substituted. As the substituents, mention may be made of a hydroxyl group, an alkoxy group, a halogen atom, a phenyl group, a dimethylamino group, an ethylene oxide group, a vinyl group, an o-carboxybenzoyloxy group, and the like.

As the (meth)acrylic acid ester, methyl acrylate, methyl methacrylate, ethyl methacrylate, isopropyl methacrylate, or n-butyl methacrylate is preferably used.

The (meth)acrylic acid esters for use in the invention may be used alone, or may also be used in combination of two or more thereof.

The content of the (meth)acrylic acid esters in the copolymer is preferably 0 to 95 mol %, more preferably 5 to 90 mol %, and further preferably 10 to 80 mol %.

The (meth)acrylamide derivative which can constitute the copolymerizable monomer component of the invention has no particular restriction so long as it is a derivative of (meth)acrylamide. However, the one represented by the following formula (c) is preferred.

Formula (c):

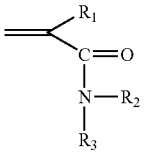

In the formula, $R_1$ represents a hydrogen atom or an alkyl group; and $R_2$ and $R_3$ each represent a hydrogen atom, an alkyl group having 1 to 10 carbon atoms, or an aryl group having 6 to 10 carbon atoms, provided that both of $R_2$ and $R_3$ will not be hydrogen atoms at the same time.

The $R_1$ represents a hydrogen atom or an alkyl group. It is preferably a hydrogen atom or an alkyl group having 1 to 4 carbon atoms.

Examples of each alkyl group having 1 to 10 carbon atoms in the $R_2$ and $R_3$ may include methyl, ethyl, n-propyl, n-butyl, isobutyl, t-butyl, n-hexyl, n-heptyl, n-octyl, and 2-ethylhexyl. Whereas, examples of the aryl group having 6 to 10 carbon atoms may include phenyl, 1-naphtyl, and 2-naphtyl. The alkyl group or the aryl group may also be substituted. As the substituents, mention may be made of a hydroxyl group, an alkoxy group, a halogen atom, a phenyl group, a dimethylamino group, an ethylene oxide group, a vinyl group, an o-carboxybenzoyloxy group, and the like. However, $R_2$ and $R_3$ will not be hydrogen atoms at the same time.

Non-limiting specific examples of (meth)acrylamide derivative in the invention will be shown below.

(c-1) N-t-butylacrylamide (c-2) N-(n-butoxymethyl)acrylamide (c-3) N-t-butylmethacrylamide (c-4) N-(1,1-dimethyl-3-oxobutyl)acrylamide (c-5) N,N-dimethylmethacrylamide (c-6) N,N-dimethylacrylamide (c-7) N-isopropylacrylamide (c-8) N-methylmethacrylamide (c-9) N-phenylmethacrylamide (c-10) N-[3-(dimethylamino)propyl]acrylamide In the copolymerizable monomer components, the (meth) acrylamide derivatives may be used alone, or may also be used in combination of two or more thereof.

The content of the (meth)acrylamide derivatives in the copolymer is preferably 0 to 95 mol %, more preferably 5 to 90 mol %, and further preferably 20 to 80 mol %.

The styrene derivative which can constitute the copolymerizable monomer component of the invention has no particular restriction so long as it is a derivative of styrene. However, the one represented by the following formula (b) is preferred.

Formula (b):

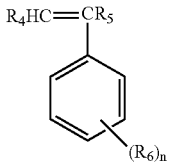

In the formula, $R_4$, $R_5$, and $R_6$ each independently represent a hydrogen atom or a substituent; and n represents an integer of 1 to 5. Although such a substituent has no particular restriction, mention may be made of an alkyl group, an aryl group, a hydroxyl group, a carboxyl group, a halogen atom, or the like.

Non-limiting specific examples of styrene derivative in the invention will be shown below.

(b-1) 4-bromostyrene (b-2) β-bromostyrene (b-3) 4-chloro-α-methylstyrene (b-4) 3-chlorostyrene (b-5) 4-chlorostyrene (b-6) 2,6-dichlorostyrene (b-7) 2-fluorostyrene (b-8) 3-fluorostyrene (b-9) 4-fluorostyrene (b-10) methylstyrene (b-11) vinyl toluene (b-12) trans-β-methylstyrene b-13

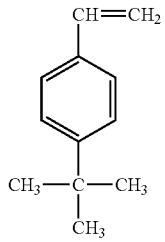

b-14

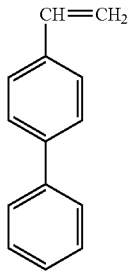

b-15

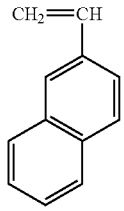

b-16

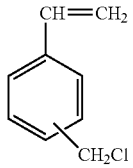

b-17

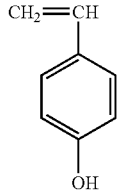

Other than the foregoing ones, mention may be made of styrene, vinyl benzoic acid, methyl vinyl benzoate, hydroxymethylstyrene, sodium p-styrene sulfonate, potassium p-styrene sulfinate, p-aminomethylstyrene, 1,4-divinylbenzene, and the like. The styrene derivatives mentioned above may be used alone, or may also be used in combination of two or more thereof.

The content of the styrene derivatives in the copolymer is preferably 0 to 95 mol %, more preferably 5 to 90 mol %, and further preferably 20 to 80 mol %.

The copolymer obtainable from the monomer of the formula (I) and the copolymerizable monomer component offers itself preferable physical properties, for example, preferable development allowance. Further, it can be copolymerized with a third copolymerizable monomer component, which enables the improvement or the modification of other various physical properties. The various other physical properties include, for example, chemical resistance, plate wear resistance, sensitivity, and developability. As the third copolymerizable monomer component, mention may be made of acrylonitrile, maleimide, vinyl acetate, N-vinyl pyrrolidone, or the like.

The weight-average molecular weight of the copolymer for use in the invention is preferably 5,000 to 200,000, further preferably 10,000 to 120,000, and particularly preferably 20,000 to 80,000. There are the following tendencies: when the molecular weight is too small, sufficient coating is unobtainable, and when it is too large, the developability is inferior.

As a process for copolymerization, a conventionally known graft copolymerization process, block copolymerization process, random copolymerization process, or the like can be used.

The content of the copolymer having the monomer unit of the formula (I) in a heat-sensitive layer is preferably 1 wt % to 40 wt %, and further preferably 2 wt % to 30 wt % based on the total solid content of the heat-sensitive layer. When it is 40 wt % or more, the plate wear resistance during burning is unfavorably reduced.

[Alkali-soluble High Molecular Weight Compound Having a Sulfonamide Group]

The heat-sensitive layer of the invention contains an alkali-soluble high molecular weight compound having a sulfonamide group. As the alkali-soluble high molecular weight compound having a sulfonamide group, mention may be made of a high molecular weight compound obtainable by homopolymerizing polymerizable monomers having sulfonamide groups, or copolymerizing the monomers with other polymerizable monomers. As the polymerizable monomers having sulfonamide groups, mention may be made of polymerizable monomers comprising low molecular weight compounds each having at least one sulfonamide group —NH—$SO_2$— in which at least one hydrogen atom is bonded onto the nitrogen atom and at least one polymerizable unsaturated bond in one molecule. Out of these, preferred are low molecular weight compounds each having an acryloyl group, an aryl group or a vinyloxy group, and a substituted or mono-substituted aminosulfonyl group or a substituted sulfonylimino group.

As the especially preferable monomers having sulfonamide groups, mention may be made of the monomers represented by the formulae 1 to 5.

Formula 1:

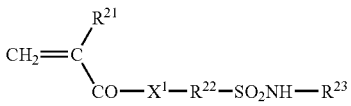

Formula 2:

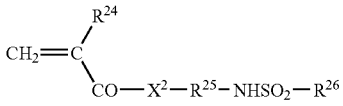

Formula 3:

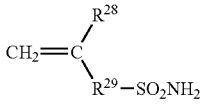

Formula 4:

-continued

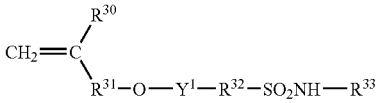

Formula 5:

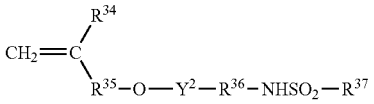

In the formulae, $X^1$ and $X^2$ each represent —O— or —$NR^{17}$—; $R^{21}$ and $R^{24}$ each represent a hydrogen atom or —$CH_3$; $R^{22}$, $R^{25}$, $R^{29}$, $R^{32}$, and $R^{36}$ each represent an alkylene group, a cycloalkylene group, an arylene group, or an aralkylene group, having 1 to 12 carbon atoms, which may have a substituent; $R^{23}$, $R^{17}$, and $R^{33}$ each represent a hydrogen atom, or an alkyl group, a cycloalkyl group, an aryl group, or an aralkyl group, having 1 to 12 carbon atoms, which may have a substituent; whereas, $R^{26}$ and $R^{37}$ each represent an alkyl group, a cycloalkyl group, an aryl group, or an aralkyl group, having 1 to 12 carbon atoms, which may have a substituent; $R^{28}$, $R^{30}$, and $R^{34}$ each represent a hydrogen atom or —$CH_3$; $R^{31}$ and $R^{35}$ each represent an alkylene group, a cycloalkylene group, an arylene group, or an aralkylene group, having 1 to 12 carbon atoms, which may have a single bond or a substituent; and $Y^1$ and $Y^2$ each represent a single bond or —CO—.

Specifically, m-aminosulfonylphenyl methacrylate, N-(p-aminosulfonylphenyl)methacrylamide, N-(p-aminosulfonylphenyl)acrylamide, and the like can be preferably used.

Non-limiting examples of other monomer components which can be copolymerized with the polymerizable monomers having the sulfonamide groups may include the compounds mentioned in the following items (m1) to (m12).

Incidentally, as a process for copolymerization of the alkali-soluble high molecular weight compound having a sulfonamide group, a conventionally known graft copolymerization process, block copolymerization process, random copolymerization process, or the like can be used.

(m-1) acrylic acid esters and methacrylic acid esters each having an aliphatic hydroxyl group, such as 2-hydroxyethyl acrylate or 2-hydroxyethyl methacrylate;

(m-2) alkyl acrylates such as methyl acrylate, ethyl acrylate, propyl acrylate, butyl acrylate, amyl acrylate, hexyl acrylate, octyl acrylate, benzyl acrylate, 2-chloroethyl acrylate, and glycidyl acrylate;

(m-3) alkyl methacrylates such as methyl methacrylate, ethyl methacrylate, propyl methacrylate, butyl methacrylate, amylmethacrylate, hexylmethacrylate, cyclohexylmethacrylate, benzyl methacrylate, 2-chloroethyl methacrylate, and glycidyl methacrylate;

(m-4) acrylamides or methacrylamides such as acrylamide, methacrylamide, N-methylolacrylamide, N-ethylacrylamide, N-hexylmethacrylamide, N-cyclohexylacrylamide, N-hydroxyethylacrylamide, N-phenylacrylamide, N-nitrophenylacrylamide, and N-ethyl-N-phenylacrylamide;

(m-5) vinyl ethers such as ethyl vinyl ether, 2-chloroethyl vinyl ether, hydroxyethyl vinyl ether, propyl vinyl ether, butyl vinyl ether, octyl vinyl ether, and phenyl vinyl ether;

(m-6) vinyl esters such as vinyl acetate, vinyl chloroacetate, vinyl butyrate, and vinyl benzoate;

(m-7) styrenes such as styrene, α-methylstyrene, methylstyrene, and chloromethylstyrene;

(m-8) vinyl ketones such as methyl vinyl ketone, ethyl vinyl ketone, propyl vinyl ketone, and phenyl vinyl ketone (m-9) olefins such as ethylene, propylene, isobutylene, butadiene, and isoprene;

(m-10) N-vinylpyrrolidone, acrylonitrile, methacrylonitrile, and the like;

(m-11) unsaturated imides such as maleimide, N-acryloylacrylamide, N-acetylmethacrylamide, N-propionylmethacrylamide, and N-(p-chlorobenzoyl)methacrylamide; and (m-12) unsaturated carboxylic acids such as acrylic acid, methacrylic acid, maleic anhydride, and itaconic acid The alkali-soluble resin having a sulfonamide group of the invention preferably has a weight-average molecular weight of 2,000 or more and a number-average molecular weight of 500 or more. It further preferably has a weight-average molecular weight of 5,000 to 300,000, a number-average molecular weight of 800 to 250,000, and a degree of dispersion (weight-average molecular weight/number-average molecular weight) of 1.1 to 10.

In the invention, the amount of the alkali-soluble resin having a sulfonamide group to be added to the heat-sensitive layer is preferably 10 to 95 wt %, and further preferably 20 to 90 wt % based on the total solid content of the light-sensitive layer. When it falls within this range, favorable scratch resistance is obtainable.

[Light-heat Conversion Material]

The heat-sensitive layer of the invention contains a light-heat conversion material which absorbs light to generate heat. Inclusion of the light-heat conversion material can result in higher sensitivity. As the light-heat conversion material, an infrared absorbing dye is preferred.

As the infrared absorbing dyes in accordance with the invention, there can be used commercially available dyes, and the known ones described in literatures (for example, *Senryo Binran*, edited by the Society of Synthetic Organic Chemistry, Japan, published in 1970). Specific examples thereof may include dyes such as azo dyes, metal complex salt azo dyes, pyrazolone azo dyes, anthraquinone dyes, phthalocyanine dyes, carbonium dyes, quinoneimine dyes, methine dyes, and cyanine dyes. In the invention, out of these dyes, the ones which particularly absorb 700 to 1200-nm infrared rays are particularly preferred in that they are suitable for use with a laser emitting an infrared ray or a near infrared ray.

Specific examples of such an infrared absorbing dye may include: cyanine dyes described in JP-A-58-125246, JP-A-59-84356, JP-A-60-78787, U.S. Pat. No. 4,973,572, and the like; methine dyes described in JP-A-58-173696, JP-A-58-181690, JP-A-58-194595, and the like; naphthoquinone dyes described in JP-A-58-112793, JP-A-58-224793, JP-A-59-48187, JP-A-59-73996, JP-A-60-52940, JP-A-60-63744, and the like; squarylium dyes described in JP-A-58-112792 and the like; and cyanine dyes described in GB No. 434,875.

Further, the near infrared absorbing sensitizers described in U.S. Pat. No. 5,156,938 are also preferably used as dyes. Whereas, mention may be made of substituted arylbenzo (thio)pyrylium salts described in U.S. Pat. No. 3,881,924, trimethinethiapyrylium salts described in JP-A-57-142645, pyrylium compounds described in JP-A-58-181051, JP-A-58-220143, JP-A-59-41363, JP-A-59-84248, JP-A-59-84249, JP-A-59-146063, and JP-A-59-146061, cyanine dyes described in JP-A-59-216146, pentamethinethiopyrylium salts and the like described in U.S. Pat. No. 4,283,475, and pyrylium compounds and the like described in JP-B-5-13514 and JP-B-5-19702, and as commercially available products, Epolight III-178, Epolight III-130, and Epolight III-125 manufactured by Epolin Co., and the like.

Further, other preferred examples thereof may include near infrared absorbing dyes described as formulae (I) and (II) in the specification of U.S. Pat. No. 4,756,993.

In the photosensitive lithographic printing plate of the invention, the infrared absorbing dye can be added in a proportion of 0.01 to 50 wt %, preferably 0.1 to 50 wt %, and particularly preferably 0.1 to 30 wt % based on the total solid content of the heat-sensitive layer. When the amount of the dye added is less than 0.01 wt %, the sensitivity tends to be reduced. Whereas, when it exceeds 50 wt %, the uniformity in the heat-sensitive layer tends to be lost, resulting in deteriorated durability of the heat-sensitive layer.

[Other Alkali-soluble Resins]

For the heat-sensitive layer of the invention, it is possible to use, if required, other alkali-soluble resins than the foregoing (A) copolymer having the monomer unit represented by the formula (I) and (B) alkali-soluble high molecular weight compound having a sulfonamide group. As such alkali-soluble resins, conventionally known ones can be used without any particular restriction. However, they are preferably high molecular weight compounds having any functional group of (1) a phenolic hydroxyl group and (2) an active imide group. Below, non-limiting specific examples thereof will be shown.

Examples of the high molecular weight compound having a phenolic hydroxyl group may include: novolak resins such as a phenol formaldehyde resin, an m-cresol formaldehyde resin, a p-cresol formaldehyde resin, an m-/p-mixed cresol formaldehyde resin, a xylenol formaldehyde resin, and a phenol/cresol (which may be any of m-, p-, or an m-/p-mixture) mixed formaldehyde resin; and a pyrogallol/acetone resin.

Other than these, as the high molecular weight compounds having a phenolic hydroxyl group, high molecular weight compounds having a phenolic hydroxyl group in the side chain are preferably used. As the high molecular weight compounds having a phenolic hydroxyl group in the side chain, mention may be made of high molecular weight compounds obtained by homopolymerization of a polymerizable monomer comprising a low molecular compound having at least one phenolic hydroxyl group and at least one polymerizable unsaturated bond or by copolymerization of the monomer with another polymerizable monomer.

As the polymerizable monomers having a phenolic hydroxyl group, mention may be made of phenolichydroxyl group-containing acrylamide, methacrylamide, acrylic acid ester, methacrylic acid ester, hydroxystyrene, and the like. Specifically, there may be preferably used N-(2-hydroxyphenyl)acrylamide, N-(3-hydroxyphenyl)acrylamide, N-(4-hydroxyphenyl)acrylamide, N-(2-hydroxyphenyl) methacrylamide, N-(3-hydroxyphenyl)methacrylamide, N-(4-hydroxyphenyl)methacrylamide, o-hydroxyphenyl acrylate, m-hydroxyphenyl acrylate, p-hydroxyphenyl acrylate, o-hydroxyphenyl methacrylate, m-hydroxyphenyl methacrylate, p-hydroxyphenyl methacrylate, o-hydroxystyrene, m-hydroxystyrene, p-hydroxystyrene, 2-(2-hydroxyphenyl)ethyl acrylate, 2-(3-hydroxyphenyl)ethyl acrylate, 2-(4-hydroxyphenyl)ethyl acrylate, 2-(2-hydroxyphenyl) ethyl methacrylate, 2-(3-hydroxyphenyl)ethyl methacrylate, 2-(4-hydroxyphenyl)ethyl methacrylate, and the like.

As the monomers to be copolymerizable with the polymerizable monomers having a phenolic hydroxyl group, mention may be made of the monomers of the items (m1) to (m12).

Such high molecular weight compounds each having a phenolic hydroxyl group may be also used in combination of two or more thereof. Further, a polycondensate of a phenol having an alkyl group having 3 to 8 carbon atoms as a substituent and formaldehyde, such as a t-butylphenol formaldehyde resin or an octylphenol formaldehyde resin described in U.S. Pat. No. 4,123,279.

(2) As the alkali-soluble high molecular weight compound having an active imide group, mention may be made of a high molecular weight compound obtainable by homopolymerization of a polymerizable monomer having at least one active imide group and at least one polymerizable unsaturated bond in one molecule, or by copolymerization of the monomer with another polymerizable monomer.

Specific preferable examples of such a polymerizable monomer having an active imide group may include N-(p-toluenesulfonyl)methacrylamide and N-(p-toluenesulfonyl) methacrylamide.

As the monomers copolymerizable with the polymerizable monomer having an active imide group, mention may be made of the monomers of the foregoing items (m1) to (m12).

Further, as the alkali-soluble resin, there can also be used a high molecular weight compound obtained by polymerization of two or more of the foregoing polymerizable monomer having a sulfonamide group, polymerizable monomer having a phenolic hydroxyl group, and polymerizable monomer having an active imide group, or a high molecular weight compound obtained by copolymerization of the two or more polymerizable monomers with another polymerizable monomer.

When the alkali-soluble resin in the photosensitive lithographic printing plate of the invention is a homopolymer or a copolymer of the polymerizable monomers, it preferably has a weight-average molecular weight of 2,000 or more and a number-average molecular weight of 500 or more. It further preferably has a weight-average molecular weight of 5,000 to 300,000, a number-average molecular weight of 800 to 250,000, and a degree of dispersion (weight-average molecular weight/number-average molecular weight) of 1.1 to 10.

Whereas, when the alkali-soluble resin is a resin such as a phenol formaldehyde resin or a cresol aldehyde resin, it preferably has a weight-average molecular weight of 500to 20,000 and a number-average molecular weight of 200 to 10,000.

These alkali-soluble resins may be used alone, or in combination of two or more thereof. It is added and used in an amount of 30to 99 wt %, preferably 40 to 95 wt %, and particularly preferably 50 to 90 wt % based on the total solid content of the heat-sensitive layer. When the amount of the alkali-soluble resins added is less than 30 wt %, the durability of the heat-sensitive layer is deteriorated. Whereas, when it exceeds 99 wt %, unfavorable results are encountered in terms of both the sensitivity and the durability.

[Dissolution Inhibiting Compound]

For the purpose of enhancing the resistance to (inhibition of) dissolution in a developer of the image portions of the photosensitive lithographic printing plate of the invention, it is possible to allow the heat-sensitive layer to contain various dissolution inhibiting compounds (inhibitors).

In the invention, known inhibitors can be used without any particular restriction. Out of these, as the preferably usable ones, mention may be made of quaternary ammonium salts, polyethylene glycol type compounds, and the like.

The quaternary ammonium salts have no particular restriction. Examples thereof may include: tetraalkylammonium salts, trialkylarylammonium salts, dialkyldiarylammonium salts, alkyltriarylammonium salts, tetraarylammonium salts, cyclic ammonium salts, bicyclic ammonium salts, and the ammonium salts described in JP-A-2002-229186. Further, the ammonium salts described in Japanese Patent Application No. 2001-398047 may also be mentioned as preferred ones.

Specifically, mention may be made of: tetrabutylammonium bromide, tetrapentylammonium bromide, tetrahexylammonium bromide, tetraoctylammonium bromide, tetralaurylammonium bromide, tetraphenylammonium bromide, tetranaphtylammonium bromide, tetrabutylammonium chloride, tetrabutylammonium iodide, tetrastearylammonium bromide, lauryltrimethylammonium bromide, stearyltrimethylammonium bromide, behenyltrimethylammonium bromide, lauryltriethylammonium bromide, phenyltrimethylammonum bromide, 3-trifluoromethylphenyltrimethylammonium bromide, benzyltrimethylammonium bromide, dibenzyldimethylammonium bromide, distearyldimethylammonium bromide, tristearylmethylammonium bromide, benzyltriethylammonium bromide, benzyltributylammonium iodide, benzyltributylammonium hexafluorophosphate, hydroxyphenyltrimethylammonium bromide, N-methylpyridinium bromide, and the like.

The amount of the quaternary ammonium salt to be added is preferably 0.1 to 50%, and more preferably 1 to 30% on a solid content basis based on the total solid content of the heat-sensitive layer. When it is 0.1% or less, the dissolution inhibiting effects are unfavorably reduced. Whereas, when it is 50% or more, the film forming property of a binder may be adversely affected.

The polyethylene glycol compounds have no particular restriction. Examples thereof may include the ones of the following structure.

$$R^1—\{—O—(R^3—O—)_m—R^2\}_n$$

(where $R^1$ represents a polyhydric alcohol residue or a polyhydric phenol residue; $R^2$, a hydrogen atom, or an alkyl group, an alkenyl group, an alkynyl group, an alkyloyl group, an aryl group, or an aryloyl group, which may have a $C_{1\ to\ 25}$ substituent; and $R^3$, an alkylene residue which may have a substituent; and m is an integer averaging 10 or more, and n is an integer of 1 or more and 4 or less.)

Examples of a polyalkylene glycol compound of the foregoing structure may include: polyethylene glycols, polypropylene glycols, polyethylene glycol alkyl ethers, polypropylene glycol alkyl ethers, polyethylene glycol aryl ethers, polypropylene glycol aryl ether, polyethylene glycol alkyl aryl ethers, polypropylene glycol alkyl aryl ethers, polyethylene glycol glycerin ester, polypropylene glycol glycerin esters, polyethylene sorbitol esters, polypropylene glycol sorbitol esters, polyethylene glycol fatty acid esters, polypropylene glycol fatty acid esters, polyethylene glycolized ethylenediamines, polypropylene glycolized ethylenediamines, polyethylene glycolized diethylenetriamines, and polypropylene glycolized diethylenetriamines.

Specific examples thereof may include: polyethylene glycol 1000, polyethylene glycol 2000, polyethylene glycol 4000, polyethylene glycol 10000, polyethylene glycol 20000, polyethylene glycol 5000, polyethylene glycol 100000, polyethylene glycol 200000, polyethylene glycol 500000, polypropylene glycol 1500, polypropylene glycol 3000, polypropylene glycol 4000, polyethylene glycol methyl ether, polyethylene glycol ethyl ether, polyethylene glycol phenyl ether, polyethylene glycol dimethyl ether, polyethylene glycol diethyl ether, polyethylene glycol diphenyl ether, polyethylene glycol lauryl ether, polyethylene glycol dilauryl ether, polyethylene glycol nonyl ether, polyethylene glycol cetyl ether, polyethylene glycol stearyl ether, polyethylene glycol distearyl ether, polyethylene glycol behenyl ether, polyethylene glycol dibehenyl ether, polypropylene glycol methyl ether, polypropylene glycol ethyl ether, polypropylene glycol phenyl ether, polypropylene glycol dimethyl ether, polypropylene glycol diethyl ether, polypropylene glycol diphenyl ether, polypropylene glycol lauryl ether, polypropylene glycol dilauryl ether, polypropylene glycol nonyl ether, polyethylene glycol acetyl ester, polyethylene glycol diacetyl ester, polyethylene glycol benzoic acid ester, polyethylene glycol lauryl ester, polyethylene glycol dilauryl ester, polyethylene glycol nonylic acid ester, polyethylene glycol cetylic acid ester, polyethylene glycol stearoyl ester, polyethylene glycol distearoyl ester, polyethylene glycol behenic acid ester, polyethylene glycol dibehenic acid ester, polypropylene glycol acetyl ester, polypropylene glycol diacetyl ester, polypropylene glycol benzoic acid ester, polypropylene glycol dibenzoic acid ester, polypropylene glycol lauric acid ester, polypropylene glycol dilauric acid ester, polypropylene glycol nonylic acid ester, polyethylene glycol glycerin ether, polypropylene glycol glycerin ether, polyethylene glycol sorbitol ether, polypropylene glycol sorbitol ether, polyethylene glycolized ethylenediamine, polypropylene glycolized ethylenediamine, polyethylene glycolized diethylenetriamine, polypropylene glycolized diethylenetriamine, and polyethylene glycolized pentamethylenehexamine.

The amount of the polyethylene glycol type compound to be added is preferably 0.1 to 50%, and more preferably 1 to 30% on a solid content basis based on the total solid content of the heat-sensitive layer. When it is 0.1% or less, the dissolution inhibiting effects are unfavorably low. Whereas, when it is 50% or more, the polyethylene glycol type compound incapable of interacting with a binder may accelerate the permeation of a developer, adversely affecting the image formability.

Whereas, when the inhibition enhancing measures are carried out, the sensitivity is reduced. In this case, it is effective to add a lactone compound. The lactone compound is considered to act as follows. When the developer permeates into the exposed portions, the developer and the lactone compound react with each other. As a result, a carboxylic acid compound is newly generated, which contributes the dissolution of the exposed portions, resulting in the improvement of the sensitivity.

The lactone compound has no particular restriction. However, examples thereof may include the compounds represented by the following formulae (L-1) and (L-II):

Formula (L-I):

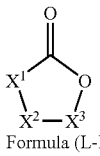

Formula (L-II):

-continued

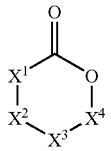

In the formulae (L-I) and (L-II), $X^1$, $X^2$, $X^3$, and $X^4$ are constituent atoms or atomic groups of a ring, which may be the same or different, and may each independently have a substituent; and at least one of $X^1$, $X^2$, and $X^3$ in the formula (L-I) and at least one of $X^1$, $X^2$, $X^3$ and $X^4$ in the formula (L-II) have electron-attracting substituents or electron-attracting group-substituted substituents.

The constituent atoms or atomic groups of the ring, represented by $X^1$, $X^2$, $X^3$, and $X^4$ are non-metal atoms having two single bonds for forming a ring, or atomic groups containing the non-metal atoms.

The non-metal atoms or non-metal atomic groups are preferably the atoms or atomic groups selected from a methylene group, a sulfinyl group, a carbonyl group, a thiocarbonyl group, a sulfonyl group, a sulfur atom, an oxygen atom, and a selenium atom, and more preferably the atomic groups selected from a methylene group, a carbonyl group, and a sulfonyl group.

At least one of $X^1$, $X^2$, and $X^3$ in the formula (L-I) and at least one of $X^1$, $X^2$, $X^3$ and $X^4$ in the formula (L-II) have electron-attracting groups. In this sepcification, the electron-attracting substituent denotes the group of which the Hammett's substituent constant up takes on a positive value. With regard to the Hammett's substituent constant, *Journal of Medicinal Chemistry,* 1973, Vol. 16, No. 11, pp. 1207 to 1216, or the like can serve as a reference. Examples of such an electron-attracting group of which the Hammett's substituent constant up takes on a positive value may include: a halogen atom (fluorine atom (σp value: 0.06), chlorine atom (σp value: 0.23), bromine atom (σp value: 0.23), iodine atom (σp value: 0.18), trihaloalkyl groups (tribromomethyl (σp value: 0.29), trichloromethyl (σp value: 0.33), and trifluoromethyl (σp value: 0.54)), a cyano group (σp value: 0.66), a nitro group (σp value: 0.78), an aliphatic-aryl or heterocyclic sulfonyl group (e.g., methanesulfonyl (σp value: 0.72)), aliphatic-aryl or heterocyclic acyl groups (e.g., acetyl (σp value: 0.50), benzoyl (σp value: 0.43), an alkynyl group (e.g., C≡CH (σp value: 0.23)), aliphatic-aryl or heterocyclic oxycarbonyl groups (e.g., methoxycarbonyl (σp value: 0.45) and phenoxycarbonyl (σp value: 0.44)), a carbamoyl group (σp value: 0.36), a sulfamoyl group (σp value: 0.57), a sulfoxide group, a heterocyclic group, an oxo group, and phosphoryl group.

The electron-attracting group is preferably a group selected from an amide group, an azo group, a nitro group, a fluoroalkyl group having 1 to 5 carbon atoms, a nitryl group, an alkoxycarbonyl group having 1 to 5 carbon atoms, an acyl group having 1 to 5 carbon atoms, an alkylsulfonyl group having 1 to 9 carbon atoms, an arylsulfonyl group having 6 to 9 carbon atoms, and alkylsulfinyl group having 1 to 9 carbon atoms, an arylsulfinyl group having 6 to 9 carbon atoms, an arycarbonyl group having 6 to 9 carbon atoms, a thiocarbonyl group, a fluorine-containing alkyl group having 1 to 9 carbon atoms, a fluorine-containing aryl group having 6 to 9 carbon atoms, a fluorine-containing allyl group having 3 to 9 carbon atoms, an oxo group, and a halogen atom.

It is more preferably a group selected from a nitro group, a fluoroalkyl group having 1 to 5 carbon atoms, a nitryl group, an alkoxycarbonyl group having 1 to 5 carbon atoms, an acyl group having 1 to 5 carbon atoms, an arylsulfonyl group having 6 to 9 carbon atoms, an arylcarbonyl group having 6 to 9 carbon atoms, an oxo group, and a halogen atom.

Below, specific examples of the compounds represented by the formulae (L-I) and (L-II) will be shown. However, the invention is not limited these compounds.

(LI-1)

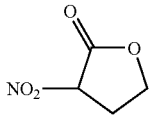

(LI-2)

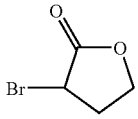

(LI-3)

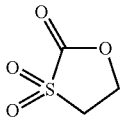

(LI-4)

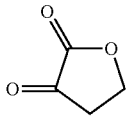

(LI-5)

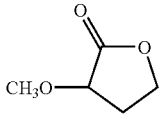

(LI-6)

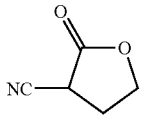

(LI-7)

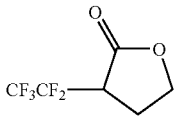

(LI-8)

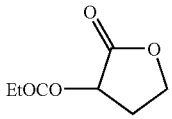

(LI-9)

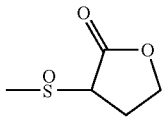

(LI-10)

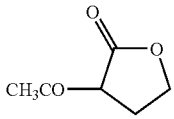

-continued (LI-11)

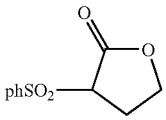

(LI-12)

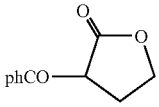

(LI-13)

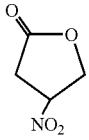

(LI-14)

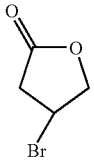

(LI-15)

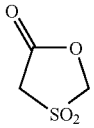

(LI-16)

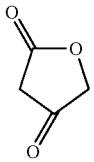

(LI-17)

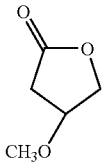

(LI-18)

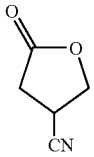

(LI-19)

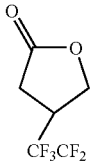

(LI-20)

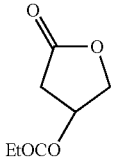

-continued (LI-21)

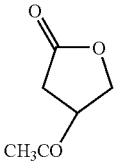

(LI-22)

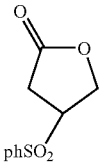

(LI-23)

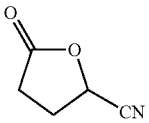

(LI-24)

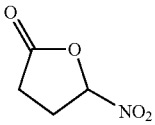

(L II-1)

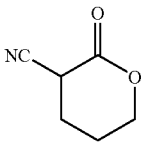

(L II-2)

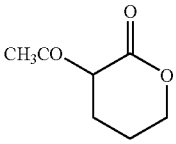

The amount of the compounds represented by the formulae (L-I) and (L-II) to be added is preferably 0.1 to 50%, and more preferably 1 to 30% on a solid content basis based on the total solid content of each layer. When it is 0.1% or less, the effects are low. Whereas, when the compounds are added in an amount of 50% or more, the image formability is inferior. Incidentally, the compounds react with a developer, and hence, desirably, the compounds selectively come in contact with the developer.

Any of the lactone compounds may be used alone, or may also be used in combination. Further, two or more compounds of the formula (L-I), or two or more compounds of the formula (L-II) may also be used in any ratio so long as the total amount of the compounds to be added falls within the foregoing range.

Whereas, it is preferable from the viewpoint of further expanding the difference between the exposed portions and the unexposed portions that the photosensitive lithographic printing plate of the invention further contains a substance which is thermally decomposable, and substantially reduces the solubility of the alkali-soluble resin in a thermally undecomposed state.

The "substance which is thermally decomposable, and substantially reduces the solubility of the alkali-soluble resin in a thermally undecomposed state" has no particular restriction. However, examples thereof may include various onium salts and quinonediazide compounds. The onium salts are preferred particularly in terms of thermal decomposability.

As onium salts, mention may be made of diazonium salts, ammonium salts, phosphonium salts, iodonium salts, sulfonium salts, selenonium salts, arsonium salts, and the like. Preferred examples of the onium salts for use in the invention may include: diazonium salts described in S. I. Schlesinger, Photogr. Sci. Eng., 18, 387 (1974), T. S. Bal et al., Polymer, 21, 423 (1980), and JP-A-5-158230; ammonium salts described in U.S. Pat. Nos. 4,069,055 and 4,069,056 and U.S. Pat. No. Re. 27,992; phosphonium salts described in D. C. Necker et al., Macromolecules, 17, 2468 (1984), C. S. Wen et al., Teh, Proc. Conf. Rad. Curing ASIA, p478, Tokyo, October (1988), and U.S. Pat. Nos. 4,069,055 and 4,069,056; iodonium salts described in J. V. Crivello et al., Macromolecules, 10(6), p. 1307 (1977), Chem. & Eng. News, November 28, p.31 (1988), EP No. 104,143, and JP-A-2-150848 and JP-A-2-296514; sulfonium salts described in J. V. Crivello et al., Polymer J., 17, 73 (1985), J. V. Crivello et al., J. Org. Chem., 43, 3055 (1978), W. R. Watt et al., J. Polymer Sci., Polymer Chem. Ed., 22, 1789 (1984), J. V. Crivello et al., Polymer Bull., 14, 279 (1985), J. V. Crivello et al., Macromolecules, 14(5), 1141 (1981), J. V. Crivello et al., J. Polymer Sci., Polymer Chem. Ed., 17, 2877 (1979), EP Nos. 370,693, 3,902,114, 233,567, 297,443 and 297,442, U.S. Pat. Nos. 4,933,377, 4,760,013, 4,734,444 and 2,833,827, and GP Nos. 2,904,626, 3,604,580 and 3,604,581; selenonium salts described in J. V. Crivello et al., Macromolecules, 10(6), 1307(1977), and J. V. Crivello et al., J. Polymer Sci., Polymer Chem. Ed., 17, 1047 (1979); and arsonium salts described in C. S. Wen et al., Teh, Proc. Conf. Rad. Curing ASIA, p478 Tokyo, October (1988).

In the photosensitive lithographic printing plate of the invention, diazonium salts are particularly preferred. Whereas, as particularly preferred diazonium salts, mention may be made of the ones described in JP-A-5-158230.

As counter ions of the onium salts, mention may be made of: anions from tetrafluoroboric acid, hexafluorophosphoric acid, triisopropylnaphthalenesulfonic acid, 5-nitro-o-toluenesulfonic acid, 5-sulfosalicylic acid, 2,5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprilnaphthalenesulfonic acid, dodecylbenzenesulfonic acid, 1-naphthol-5-sulfonic acid, 2-methoxy-4-hydroxy-5-benzoyl-benzenesulfonic acid, and para-toluenesulfonic acid, and the like. Out of these, hexafluorophosphate, and alkylaromatic sulfonates such as triisopropylnaphthalenesulfonate and 2,5-dimethylbenzenesulfonate are particularly preferred. The amount of the foregoing substance to be added is preferably 1 to 50 wt %, further preferably 0.1 to 30 wt %, and particularly preferably 0.3 to 30 wt %.

As preferred quinonediazides, mention may be made of o-quinonediazide compounds. The o-quinonediazide compounds usable in the invention are compounds each of which has at least one o-quinonediazido group, and increases in alkali solubility when thermally decomposed. The compounds of various structures are usable. In other words, o-quinonediazide loses an ability of inhibiting the dissolution of alkali-soluble resins by thermal decomposition, and, o-quinonediazide itself is changed into an alkali-soluble substance. By both the effects, it assists the dissolution of the underlying layer. As the o-quinonediazide compounds usable in the invention, there can be used the compounds described in, for example, *Light-Sensitive Systems* (John Wiley & Sons, Inc.), pp. 339 to 352, written by J. Kosar. Particularly, sulfonic acid esters or sulfonic acid amides of o-quinonediazides produced by reaction with various aromatic polyhydroxy compounds or aromatic amino compounds. Whereas, esters of benzoquinone-(1,2)-diazidosulfonic acid chloride or naphthoquinone-(1,2)-diazido-5-sulfonic acid chloride and pyrogallol/acetone resins as disclosed in JP-B-43-28403, and esters of benzoquinone-(1,2)-diazidosulfonic acid chloride or naphthoquinone-(1,2)-diazido-5-sulfonic acid chloride and phenol-formaldehyde resins described in U.S. Pat. Nos. 3,046,120 and 3,188,210 are also preferably used.

Further, similarly, esters of naphthoquinone-(1,2)-diazido-4-sulfonic acid chloride and phenol formaldehyde resins or cresol-formaldehyde resins, and esters of naphthoquinone-(1,2)-diazido-4-sulfonic acid chloride and pyrogallol-acetone resins are also preferably used. Other useful o-quinonediazide compounds are reported in a large number of patents, and known. Examples thereof may include: the ones described in JP-A-47-5303, JP-A-48-63802, JP-A-48-63803, JP-A-48-96575, JP-A-49-38701, JP-A-48-13354, JP-B-41-11222, JP-B-45-9610, JP-B-49-17481, U.S. Pat. Nos. 2,797,213, 3,454,400, 3,544,323, 3,573,917, 3,674,495, and 3,785,825, GB Nos. 1,277,602, 1,251,345, 1,267,005, 1,329,888, and 1,330,932, and GP No. 854,890. The o-quinonediazide compounds for use in the invention are added in an amount in the range of preferably 1 to 50 wt %, further preferably 5 to 30 wt %, and particularly preferably 10 to 30 wt % based on the total solid content of the underlayer. These compounds may be used alone, or may also be used in mixture of several ones thereof. When the amount of o-quinonediazide compounds added is less than 1 wt %, the image recordability is degraded. Whereas, when it exceeds 50 wt %, the durability of image portions is deteriorated, and the sensitivity is reduced.

Incidentally, the thermally decomposable substances are preferably onium salts from the viewpoint of decomposability.

Conceivably, by using the highly thermally decomposable onium salts, the decomposition of the thermally decomposable substances at exposed portions is promoted to improve the discrimination between the exposed portions and the unexposed portions.

For forming a heat-sensitive layer, it is possible to further add various additives, if required, in addition to the foregoing components, so long as the effects of the invention are not impaired. Below, a description will be given by mentioning examples of additives.

For example, for the purposes of enhancing the discrimination between the image portions and the non-image portions, and enhancing the resistance to scratches on the surface, it is preferable to use in combination a polymer containing a (meth) acrylate monomer having 2 or 3 perfluoroalkyl groups each having 3 to 20 carbon atoms in the molecule as a polymerizable component as described in JP-A-2000-187318.

The polymer is added in an amount of preferably 0.1 to 10 wt %, and more preferably 0.5 to 5 wt % based on the total solid content of the heat-sensitive layer.

It is also possible to add a compound for reducing the coefficient of static friction of the surface in the photosensitive lithographic printing plate of the invention for the purpose of imparting the resistance to scratches. Specific examples may include the long-chain alkyl carboxylic acid esters as used in U.S. Pat. No. 6,117,913.

The compounds are added in a proportion of preferably 0.1 to 10 wt %, and more preferably 0.5 to 5 wt % based on the amount of the layer-forming material.

Further, if required, a compound having a low molecular weight acidic group may also be contained. As the acidic groups, mention may be made of sulfonic acid, carboxylic acid, and phosphoric acid groups. Out of these, a compound having a sulfonic acid group is preferred. Specific examples thereof may include aromatic sulfonic acids such as p-toluenesulfonic acid and naphthalenesulfonic acid and aliphatic sulfonic acids.

The compounds are added in a proportion of preferably 0.05 to 5 wt %, and more preferably 0.1 to 3 wt % based on the amount of the layer-forming material. When they are added in an amount of more than 5 wt %, the solubility of the heat-sensitive layer in a developer unfavorably increases.

Whereas, in the invention, various dissolution inhibitors may also be contained for the purpose of controlling the solubility. As the dissolution inhibitors, the disulfone compounds or sulfone compounds as shown in JP-A-11-119418 are preferably used. As a specific example, 4,4'-bishydroxyphenylsulfone is preferably used.

The compounds are added in a proportion of preferably 0.05 to 20 wt %, and more preferably 0.5 to 10 wt % based on the solid content of the heat-sensitive layer.

Whereas, for the purpose of further improving the sensitivity, cyclic acid anhydrides, phenols, and organic acids may also be used in combination. As the cyclic acid anhydrides, there are usable phthalic anhydride, tetrahydrophthalic anhydride, hexahydrophthalic anhydride, 3,6-endoxy-Δ4-tetrahydrophthalic anhydride, tetrachlorophthalic anhydride, maleic anhydride, chloromaleic anhydride, α-phenylmaleic anhydride, succinic anhydride, pyromellitic anhydride, and the like described in U.S. Pat. No. 4,115,128. Examples of phenols may include bisphenol A, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane, and 4,4',3",4"-tetrahydroxy-3,5,3',5'-tetramethyltriphenylmethane. Further, organic acids include the sulfonic acids, sulfinic acids, alkylsulfuric acids, phosphonic acids, phosphoric acid esters, and carboxylic acids, and the like described in JP-A-60-88942, JP-A-2-96755, and the like. Specific examples may include p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluic acid, 3,4-dimethoxybenzoic acid, phthalic acid, terephthalic acid, 4-cyclohexene-1,2-dicarboxylic acid, erucic acid, lauric acid, n-undecanoic acid, and ascorbic acid. The proportion of the cyclic acid anhydrides, phenols, and organic acids in the heat-sensitive layer solid content is preferably 0.05 to 20 wt %, more preferably 0.1 to 15 wt %, and particularly preferably 0.1 to 10 wt %.

Further, in order to extend the stability of processing for developing conditions, the nonionic surfactants as described in JP-A-62-251740 and JP-A-3-208514, the amphoteric surfactants as described in JP-A-59-121044 and JP-A-4-13149, the siloxane type compounds as described in EP No. 950517, and a fluorine-containing monomer copolymer as described in JP-A-11-288093 can be added to the heat-sensitive layer coating solution.

Specific examples of nonionic surfactants may include sorbitan tristearate, sorbitan monopalmitate, sorbitan trioleate, stearic acid monoglyceride, and polyoxyethylene nonylphenyl ether. Specific examples of amphoteric surfactants may include alkyldi(aminoethyl)glycines, alkylpolyaminoethylglycine hydrochlorides, 2-alkyl-N-carboxyethyl-N-hydroxyethyl imidazolinium betaines, and N-tetradecyl-N,N-betaine types (e.g., trade name "Amorgen K,": produced by DAI-ICHI KOGYO SEIYAKU CO., LTD.).

The siloxane type compounds are preferably block copolymers of dimethylsiloxane and polyalkylene oxide. Specific examples thereof may include DBE-224, DBE-621, DBE-712, DBP-732, DBP-732, and DBP-534, produced by CHISSO CORPORATION, and polyalkylene oxide modified silicones such as Tego Glide 100 produced by German Tego Corp.

The proportion of the nonionic surfactants and the amphoteric surfactants in a coating solution material is preferably 0.05 to 15 wt %, and more preferably 0.1 to 5 wt %.

Further, it is possible to add a printing-out agent for obtaining a visible image immediately after heating by exposure, and a dye or a pigment as an image coloring agent into the heat-sensitive layer.

Typical examples of the printing-out agent may include combinations of compounds releasing an acid by heating through light exposure (light acid releasing agents) and organic dyes capable of forming a salt. Specific examples of the combination may include combinations of o-naphthoquinonediazide-4-sulfonic acid halogenide with salt-forming organic dyes described in JP-A-50-36209 and JP-A-53-8128, and combinations of trihalomethyl compounds with salt-forming organic dyes described in JP-A-53-36223, JP-A-54-74728, JP-A-60-3626, JP-A-61-143748, JP-A-61-151644, and JP-A-63-58440. As such trihalomethyl compounds, there are oxazole type compounds and triazine type compounds. Both are excellent in stability over time, and provide clear print-out images.

As coloring agents of images, it is possible to use other dyes than the above-described salt-forming organic dyes. Oil-soluble dyes and basic dyes can be mentioned as preferred dyes including the salt-forming organic dyes. Specific examples thereof may include: Oil Yellow #101, Oil Yellow #103, Oil Pink #312, Oil Green BG, Oil Blue BOS, Oil Blue #603, Oil Black BY, Oil Black BS, and Oil Black T-505 (all produced by Orient Chemical Industries, Ltd.), Victoria Pure Blue, Crystal Violet (C.I. 42555), Methyl Violet (C.I. 42535), Ethyl Violet, Rhodamine B (C.I. 145170B), Malachite Green (C.I. 42000), and Methylene Blue (C.I. 52015). Further, the dyes described in JP-A-62-293247 are particularly preferred. These dyes can be added in a proportion of 0.01 to 10 wt %, and preferably 0.1 to 3 wt % based on the total solid content of the heat-sensitive layer.

Further, into the heat-sensitive layer of the invention, if required, a plasticizer is added in order to impart flexibility of a coating film, and the like. For example, there are usable butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and oligomers and polymers of acrylic acid or methacrylic acid.

[Formation of the Heat-sensitive Layer]

The heat-sensitive layer of the invention can be formed by dissolving required components in a solvent, and coating the resulting solution on a support. Non-limiting examples of the solvent herein used may include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulfolane, γ-butyrolactone, and toluene. The solvents may be used alone or in mixture thereof.

The concentration of a heat-sensitive layer coating solution using the solvent is preferably 1 to 50 wt %.

Whereas, the amount (solid content) of the heat-sensitive layer to be coated varies according to the intended purpose. It is preferably 0.5 to 3.0 g/m$^2$. There are the following tendencies: when it is less than 0.5 g/m$^2$, the film characteristics are degraded; whereas, when it exceeds 3.0 g/m$^2$, the sensitivity is reduced.

As the processes for coating the heat-sensitive layer on the support, various processes can be employed. Examples thereof may include bar coater coating, rotary coating, spray coating, curtain coating, dip coating, air knife coating, blade coating, and roll coating.

A surfactant such as a fluorine-containing surfactant as described in JP-A-62-170950 for improving the coatability can be added to the heat-sensitive layer of the invention. it is added in an amount of preferably 0.01 to 1 wt %, and more preferably 0.05 to 0.5 wt % based on the total solid content of the layer to which it is added.

In the infrared-sensitive lithographic printing plate of the invention, the heat-sensitive layer formed in the foregoing manner may be a single layer, or may also be formed in a multilayered structure comprising an upper layer and a lower layer.

When it is formed in a multilayered structure, the layer (lower layer) closer to the support may also be a layer not containing a light-heat conversion material. Namely, it is essential only that any layer of the upper layer and the lower layer contains therein (A) a copolymer having the monomer unit represented by the formula (I), (B) an alkali-soluble high molecular weight compound having a sulfonamide group, and (C) a light-heat conversion material.

Further, when it is formed in a multilayered structure, it is preferable from the viewpoints of the development latitude and the scratch resistance that the lower layer is not allowed to contain the copolymer having the monomer unit represented by the formula (I), or is allowed to contain the monomer unit in a smaller amount than with the upper layer, for use.

Although the amounts (solid contents) of the upper layer and the lower layer to be coated when the layer is formed in a multilayered structure vary according to the intended purpose, the amounts are preferably 0.05 to 1.0 g/m$^2$ for the upper layer, and 0.3 to 3.0 g/m$^2$ for the lower layer. There arise possibilities as follows: when the amount is less than 0.05 g/m$^2$ for the upper layer, the image formability is degraded; and when it exceeds 1.0 g/m$^2$, the sensitivity is reduced. Further, the total amount of the two layers to be coated is preferably 0.5 to 3.0 g/m$^2$. There are the following tendencies: when it is less than 0.5 g/m$^2$, the film characteristics are degraded; whereas, when it exceeds 3.0 g/m$^2$, the sensitivity is reduced.

[Support]

As the support of the invention, mention may be made of a dimensionally stable plate-like article having a required strength and durability. Examples thereof may include paper, paper laminated with plastic (e.g., polyethylene, polypropylene, or polystyrene), metal plates (e.g., aluminum, zinc, and copper), plastic films (e.g., cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinylacetal), and paper or plastic films laminated or vapor deposited with the above-mentioned metals.

The supports of the photosensitive lithographic printing plates of the invention are preferably polyester films or aluminum plates. Out of these, the aluminum plates which are good in dimensional stability and relatively inexpensive are particularly preferred. Preferred aluminum plates are a pure aluminum plate and alloy plates comprising aluminum as a main component and containing foreign elements in slight amounts. Further, they may also be aluminum-laminated or deposited plastic films. The foreign elements contained in the aluminum alloys include silicon, iron, manganese, copper, magnesium, chromium, zinc, bismuth, nickel, and titanium. The content of the foreign elements in the alloy is at most 10 wt % or less. Although aluminum particularly preferred in the invention is pure aluminum, the perfectly pure aluminum is difficult to manufacture in terms of the smelting technique. For this reason, aluminum containing trace amounts of foreign elements is also acceptable.

Thus, the aluminum plates to be applied to the invention are not specified in their compositions, and the aluminum plates of conventional raw materials well known in the art can be appropriately utilized. The thickness of the aluminum plates for use in the invention is about 0.01 mm to 0.6 mm, preferably 0.15 mm t 0.4 mm, and particularly preferably from 0.2 mm to 0.3 mm.

Prior to surface roughening of the aluminum plate, if desired, a degreasing treatment for removing a rolling oil on the surface thereof is carried out, for example, with a surfactant, an organic solvent, or an alkali aqueous solution. The surface roughening treatment of the aluminum plate is carried out by various methods. It is carried out with, for example, methods of mechanically roughening the surface, methods of electrochemically roughening the surfaces by dissolution, and methods of selectively dissolving the surface chemically. As the mechanical methods, known methods such as a ball polishing method, a brush polishing method, a blast polishing method, and a buff polishing method can be used. Whereas, the electrochemical surface roughening methods include methods which are carried out in a hydrochloric acid or nitric acid electrolyte with alternating current or direct current. Further, the method of a combination of both the methods as described in JP-A-54-63902 can also be utilized. The aluminum plate surface-roughened in this manner is subjected to, if required, an alkali etching treatment and to a neutralizing treatment. Then, it is subjected to an anodic oxidization treatment for enhancing the water retention and the abrasion resistance of the surface, if desired. As the electrolytes to be used for the anodic oxidation treatment of the aluminum plate, various electrolytes for forming a porous oxide film can be used. In general, sulfuric acid, phosphoric acid, oxalic acid, or chromic acid, or a mixed acid thereof is used. The concentration of the electrolyte is appropriately determined according to the kind of the electrolyte.

Treatment conditions of the anodic oxidation vary variously according to the electrolyte to be used, and hence cannot be determined indiscriminately. However, generally, the conditions are proper so long as the concentrion of the electrolyte falls within a range of 1 to 80 wt %; the solution temperature, 5 to 70° C.; the electric current density, 5 to 60 A/dm$^2$; the voltage, 1 to 100 V; and the electrolysis time, 10 seconds to 5 minutes. When the amount of anodic oxidation coating film is less than 1.0 g/m$^2$, the plate wear resistance is insufficient, and the non-image portions of the lithographic printing plate become more liable to be scratched.

As a result, so-called "scratch stain", i.e., adhesion of ink at scratched sites upon printing, becomes more likely to occur. After carrying out the anodic oxidation treatment, the aluminum surface is subjected to a hydrophilization treatment, if required. As the hydrophilization treatment to be performed on the support of a master plate in accordance with the invention, there is an alkali metal silicate (e.g., a sodium silicate aqueous solution) method as disclosed in U.S. Pat. Nos. 2,714,066, 3,181,461, 3,280,734 and 3,902,734. With this method, the support is subjected to an immersion treatment or an electrolysis treatment in a sodium silicate aqueous solution. Alternatively, there are used methods of carrying out the treatment with potassium fluorozirconate as described in JP-B-36-22063, and polyvinyl phosphonic acid as disclosed in U.S. Pat. Nos. 3,276,868, 4,153,461, and 4,689,272, and other methods.

The photosensitive lithographic printing plate of the invention comprises a support having a heat-sensitive layer provided thereon, and, if required, may comprise an undercoat layer provided between the support and the heat-sensitive layer.

As undercoat layer components, various organic compounds are used, which are selected from, for example, carboxymethylcellulose, dextrin, gum arabic, amino group-containing phosphonic acids such as 2-aminoethylphosphonic acid, organophosphonic acids such as phenylphosphonic acids, naphthylphosphonic acid, alkylphosphonic acid, glycerophosphonic acid, methylenediphosphonic acid, and ethylenediphosphonic acid, which may have substituents, organophosphoric acids such as phenylphosphoric acids, naphthylphosphoric acid, alkylphosphoric acid, and glycerophosphoric acid, which may have substituents, organophosphinic acids such as phenylphosphinic acids, naphthylphosphinic acid, alkylphosphinic acid, and glycerophosphinic acid, which may have substituents, amino acids such as glycine and β-alanine, and hydroxyl group-containing amine hydrochlorides such as triethanolamine hydrochloride. These may be also used in mixture of two or more thereof.

The undercoat layer containing at least one compound selected from the organic high molecular weight compound group having a structural unit represented by the following formula:

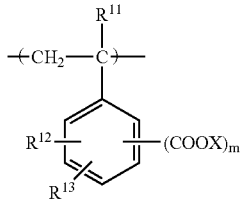

wherein $R^{11}$ represents a hydrogen atom, a halogen atom, or an alkyl group; $R^{12}$ and $R^{13}$ each independently represent a hydrogen atom, a hydroxyl group, a halogen atom, an alkyl group, a substituted alkyl group, an aryl group, a substituted aryl group, —$OR^{14}$, —$COOR^{15}$, —$CONHR^{16}$, —$COR^{17}$, or —CN, or $R^{12}$ and $R^{13}$ may also be combined with each other to form a ring, where $R^{14}$ to $R^{17}$ each independently represent an alkyl group or an aryl group; X denotes a hydrogen atom, a metal atom, or $NR^{18}R^{19}R^{20}R^{21}$, where $R^{18}$ to $R^{21}$ each independently represent a hydrogen atom, an alkyl group, a substituted group, an aryl group, or a substituted aryl group, or $R^{18}$ and $R^{19}$ may also be combined with each other to form a ring; and m represents an integer of 1 to 3.

The undercoat layer maybe provided in the following manner. Namely, there are the following methods: a method in which a solution of the aforesaid organic compound dissolved in water or an organic solvent such as methanol, ethanol, or methyl ethyl ketone, or a mixed solvent thereof is coated on an aluminum plate, followed by drying; and a method in which an aluminum plate is immersed in a solution of the aforesaid organic compound dissolved in water or an organic solvent such as methanol, ethanol, methyl ethyl ketone, or a mixed solvent thereof, thereby to adsorb the compound thereon, followed by washing with water or the like, and drying to form an undercoat layer. With the former method, it is possible to coat a solution of the organic compound with a concentration of 0.005 to 10 wt % through various processes. Whereas, with the latter method, the concentration of the solution is 0.01 to 20 wt %, and preferably 0.05 to 5 wt %, the immersion temperature is 20 to 90° C., and preferably 25 to 50° C., and the immersion time is 0.1 second to 20 minutes, and preferably 2 seconds to 1 minute. The solution to be herein used may also be adjusted to a pH in the range of 1 to 12 by a basic substance such as ammonia, triethylamine, or potassium hydroxide, or an acidic substance such as hydrochloric acid or phosphoric acid. Whereas, a yellow dye may also be added thereto in order to improve the tone reproducibility of the photosensitive lithographic printing plate.

The amount of the undercoat layer to be coated is properly 2 to 200 mg/$m^2$, and preferably 5 to 100 mg/$m^2$. When the amount of coating is less than 2 mg/$m^2$, sufficient plate wear resistance performance cannot be obtained. Further, the same also applies to the case where the coating amount is more than 200 mg/$m^2$.

[Plate-making/Printing]

The photosensitive lithographic printing plates produced in the foregoing manner are stacked one on another with interleaving paper sheets inserted between the photosensitive lithographic printing plates, and thus packaged. They are shipped, transported, and stored in such a product form in accordance with the general embodiment. Non-limiting typical embodiment for plate-making/printing is the embodiment as follows: with an auto-loader, a set of stacked interleaving paper sheets and master plates are held on the auto-loader, transported, and mounted/fixed at a position where plate-making is carried out, and then the interleaving paper sheets are removed therefrom.

The master plates from which the interleaving paper sheets have been removed are subjected to image exposure and a development treatment.

The light source of an active ray for use in image exposure is preferably a light source having an emission wavelength within the near-infrared to infrared region. Further, it is not necessarily required to be of a scanning system, in other words, it may be of a surface exposure system. However, exposure of a scanning system using a solid laser or a semiconductor laser is preferred. The emission wavelength is preferably 760 to 1080 nm.

The developers applicable to the photosensitive lithographic printing plate of the invention are the developers having a pH in a range of 9.0 to 14.0, and preferably in a range of 12.0 to 13.5. Conventionally known alkali aqueous solution can be used as the developers (hereinafter, those including replenishing solutions are referred to as developers). Examples thereof may include inorganic alkali salts such as sodium silicate, potassium silicate, sodium tertiary phosphate, potassium tertiary phosphate, ammonium tertiary phosphate, sodium secondary phosphate, potassium secondary phosphate, ammonium secondary phosphate, sodium carbonate, potassium carbonate, ammonium carbonate, sodium hydrogencarbonate, potassium hydrogencarbonate, ammonium hydrogencarbonate, sodium borate, potassium borate, ammonium borate, sodium hydroxide, ammonium hydroxide, potassium hydroxide, and lithium hydroxide. Further, other examples thereof may include organic alkali agents such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, and pyridine. These alkali aqueous solutions may be used alone or in combination of two or more thereof.

Out of the alkali aqueous solutions, one of the developers capable of bringing out the effects of the invention is an aqueous solution having a pH of 12 or more, referred to as a so-called "silicate developer", which contains alkali silicate as a base or contains alkali silicate obtained by mixing a silicon compound to a base, and another more preferred developer thereof is a so-called "non-silicate developer" which does not contain alkali silicate and contains a non-reducing sugar (an organic compound having a buffer action) and a base.

For the former case, the aqueous solution of alkali metal silicate can be controlled in the developability by the ratio of silicone oxide $SiO_2$ as a component of the silicate to the alkali metal oxide $M_2O$ (generally expressed by the molar ratio of $[SiO_2]/[M_2O]$), and the concentrations thereof. For example, there are preferably used an aqueous solution of sodium silicate having an $SiO_2/Na_2O$ molar ratio of 1.0 to 1.5 (i.e., $[SiO_2]/[Na_2O]$ being 1.0 to 1.5) and an $SiO_2$ content of 1 to 4 wt %, as disclosed in JP-A-54-62004; and an aqueous solution of alkali metal silicate having an $[SiO_2]/[M]$ of 0.5 to 0.75 (i.e., $[SiO_2]/[M_2O]$ being 1.0 to 1.5) and an $SiO_2$ concentration of 1 to 4 wt %, and the developer containing potassium in an amount of at least 20 wt % based on the total gram atom of the alkali metals present therein, as disclosed in JP-B-57-7427.

Further, the so-called "non-silicate developer" not containing alkali silicate and containing a non-reducing sugar and a base is further preferably applied to the development of the lithographic printing plate material of the invention. When the development treatment of the lithographic printing plate material is carried out using this developer, the surface of the photosensitive layer will not be deteriorated, and it is possible to keep the ink receptibility of the photosensitive layer in a favorable state. Further, in general, the lithographic printing plate material has a narrow development latitude, and the printing area width or the like greatly varies depending on the pH of the developer. However, the non-silicate developer contains a non-reducing sugar having a buffering property of suppressing the fluctuation of pH, and hence, it is advantageous as compared with the case using the development treating solution containing silicate. Furthermore, the non-reducing sugar hardly contaminates an electro-conductivity sensor or a pH sensor for controlling the degree of liquid activity, or other units as compared with silicate. For this reason, the non-silicate developer is also advantageous in this respect. Whereas, it has a remarkable effect of improving the discrimination between the image portions and the non-image portions. This is presumably due to the following fact: in this invention, the contact with (penetration of) the developer important for holding the discrimination and the film physical properties becomes mild, and hence, the difference between the exposed portions and the unexposed portions becomes more likely to be caused.

The non-reducing sugars are sugars not containing a free aldehyde group or ketone group and not exhibiting reducing property. The non-reducing sugars are classified into trehalose-type oligosaccharides in which reducing groups are bonded to each other, glycosides in which reducing groups of the sugars and non-sugars are bonded, and sugar-alcohols obtained by hydrogenating and thereby reducing sugars. All may be preferably used in the invention. Incidentally, in the invention, the non-reducing sugars described in JP-A-8-305039 may be preferably used.

Examples of the trehalose-type oligosaccharides may include saccharose and trehalose. Examples of the glycosides may include alkyl glycoside, phenol glycoside, and mustard oil glycoside. Examples of the sugar-alcohols may include D,L-arabite, ribit, xylite, D,L-sorbit, D,L-mannite, D,L-idit, D,L-talit, dulcite, and allo-dulcite. Further, maltitol resulting from the hydrogenation of maltose of disaccharides, a reduction product (reduced starch syrup) obtained by the hydrogenation of oligosaccharide, and the like maybe preferably mentioned. Out of these non-reducing sugars, trehalose-type oligosaccharides and sugar-alcohols are preferred, and especially, D-sorbit, saccharose, reduced starch syrup, and the like are preferred in that these have a buffer action in a proper pH region and are inexpensive.

These non-reducing sugars may be used alone, or may also be used in combination of two or more thereof. The content of the non-reducing sugar in the non-silicate developer is preferably 0.1 to 30 wt %, and more preferably 1 to 20 wt %. When this content is less than 0.1 wt %, a sufficient buffer action tends to become unobtainable, whereas, when it exceeds 30 wt %, there are tendencies that high concentration becomes difficult to perform and that the cost is increased.

Examples of the base to be used in combination with the non-reducing sugar may include conventionally known alkali agents such as inorganic alkali agents and organic alkali agents. Examples of the inorganic alkali agent may include sodium hydroxide, potassium hydroxide, lithium hydroxide, trisodium phosphate, tripotassium phosphate, triammonium phosphate, disodium phosphate, dipotassium phosphate, diammonium phosphate, sodium carbonate, potassium carbonate, ammonium carbonate, sodium hydrogencarbonate, potassium hydrogencarbonate, ammonium hydrogen carbonate, sodium borate, potassium borate, and ammonium borate.

Examples of the organic alkali agent may include monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, and pyridine.

These bases may be used individually alone, or may also be used in combination of two or more thereof. Out of these bases, sodium hydroxide and potassium hydroxide are preferred.

Alternatively, in the invention, it is also possible to use, as the non-silicate developer, the one containing an alkali metal salt of the non-reducing sugar as a main component in place of the combination of the non-reducing sugar and the base.

Further, with the non-silicate developer, an alkaline buffer solution comprising a weak acid other than the non-reducing sugar and a strong base may be used in combination. The weak acid preferably has a dissociation constant (pKa) of from 10.0 to 13.2, and may be selected from the ones described, for example, in *Ionization Constants of Organic Acids in Aqueous Solution*, issued by Pergmon Press.

Specific preferred examples thereof may include: alcohols such as 2,2,3,3-tetrafluoropropanol-1, trifluoroethanol, and trichloroethanol; aldehydes such as pyridine-2-aldehyde and pyridine-4-aldehyde; compounds having a phenolic hydroxyl group, such as salicylic acid, 3-hydroxy-2-naphthoic acid, catechol, gallic acid, sulfosalicylic acid, 3,4-dihydroxysulfonic acid, 3,4-dihydroxybenzoic acid, hydroquinone (pKa: 11.56), pyrogallol, o-, m-, and p-cresols, and resorcinol; oximes such as acetoxime, 2-hydroxybenzaldehydeoxime, dimethylglyoxime, ethanediamide dioxime, and acetophenone oxime; nucleic acid related substances such as adenosine, inosine, guanine, cytosine, hypoxanthine, and xanthine; and in addition, dimethylaminomethylphosphonic acid, benzimidazole, and barbituric acid.

To the developer or the replenishing solution, various surfactants and organic solvents can be added, if required, for the purpose of promoting or suppressing the developability, dispersing the development residue, or enhancing the affinity of the printing plate image portions for ink. The surfactants are preferably anionic, cationic, nonionic, and amphoteric surfactants. Further, to the developer and the replenishing solution, if required, a reducing agent such as hydroquinone, resorcin, and a sodium salt or a potassium salt of an inorganic acid such as sulfurous acid or sulfurous hydrogen acid; and further, an organic carboxylic acid; an antifoaming agent; a hard-water softener, and the like may also be added.

The image forming materials subjected to a development treatment by using the above-mentioned developers and replenishing solutions are post treated with washing water, a rinsing solution containing a surfactant, or the like, and a desensitizing solution containing gum arabic or a starch derivative. As the post-treatment when the image forming materials are used as printing plates, these treatments can be used in various combinations thereof.

In plate making and printing industries, an automatic developing machine has been widely used for the stable development operation of preexposed photosensitive lithographic printing plates. This automatic developing machine generally comprises a developing section and a post-treatment section, and comprises a device for conveying a printing plate, respective processing solution tanks, and a spray device, whereby the respective processing solutions pumped up by a pump are sprayed on a preexposed printing plate from spray nozzles while the plate is being fed horizontally, thereby to carry out the development treatment. Whereas, recently, there has also been known a method in which a printing plate is processed by being immersed and conveyed in the processing solution tanks filled with processing solutions by means of submerged guide rolls or the like. With such automatic processing, processing can be effected while replenishing the respective processing solutions with their corresponding replenishing solutions according to the amount of processing, the operation time, and the like.

The infrared-sensitive lithographic printing plate of the invention is applicable to the processing by means of the automatic developing machine. Alternatively, it is also applicable to a processing method in which unused processing solutions are supplied for every photosensitive lithographic printing plate, i.e., a so-called single-use processing method.

In the plate-making operation of the photosensitive lithographic printing plate of the invention, when there are unnecessary image portions on a lithographic printing plate obtained through image exposure, development, water-washing and/or rinsing, and/or gumming, the unnecessary image portions are erased. For such erasure, preferable is a process in which the unnecessary image portions are coated with an erasing solution, and left standing as they are for a prescribed period of time, followed by water washing, as described in, for example, JP-B No. 2-13293. However, there may also be utilized a process in which the unnecessary image portions are irradiated with an active ray guided by an optical fiber, followed by development, as described in JP-A No. 59-174842.

The printing plate obtained in the foregoing manner may be, if required, coated with desensitized gum, and then subjected to a printing step. However, when it is desired to be processed into a further higher plate wear lithographic printing plate, it is subjected to a burning treatment. When the lithographic printing plate undergoes burning, it is preferably treated with a counter-etching solution as described in JP-B-61-2518, JP-B-55-28062, JP-A-62-31859, and JP-A-61-159655, prior to burning.

As the method, there is applied a method in which the counter-etching solution is coated on the lithographic printing plate by a sponge or absorbent cotton soaked with the solution, or the printing plate is immersed in a vat filled with the counter-etching solution; or coating by means of an automated coater. Further, when the amount of the solution coated is homogenized by means of a squeegee or a squeezing roller after coating, a better result is provided.

A proper amount of the counter-etching solution to be coated is generally 0.03 to 0.8 g/m$^2$ (dry mass). The lithographic printing plate coated with the counter-etching solution is, if required, heated to a high temperature by means of a burning processor (e.g., BURNING PROCESSOR: "BP-1300" marketed from Fuji Photo Film Co., Ltd.), or the like after drying. The heating temperature and time in this case vary depending on the kinds of components constituting the image, but preferably fall within the range of 180 to 300° C., and in the range of 1 to 20 minutes, respectively.

The burning-treated lithographic printing plate may be, appropriately, if required, subjected to conventionally employed treatments such as water washing and gumming. However, when a counter-etching solution containing a water-soluble high molecular weight compound, and the like is used, it is possible to omit the so-called desensitizing treatment such as gumming. The lithographic printing plate obtained by such treatments are put in an offset printer or the like, and used for printing of a large number of sheets.

EXAMPLES

Below, the invention will be described by way of examples, which should not be construed as limiting the scope of the invention.

[Preparation of Support]

(Preparation of Support 1)

A 0.24 mm-thick aluminum plate (aluminum alloy containing Si: 0.06 wt %, Fe: 0.30 wt %, Cu: 0.014 wt %, Mn: 0.001 wt %, Mg: 0.001 wt %, Zn: 0.001 wt %, and Ti: 0.03 wt %, with the balance being Al and inevitable impurities) was continuously subjected to the following surface treatment.

While feeding a suspension of abrasive (quartz sand) in water, having a specific gravity of 1.12 as an abrasive slurry solution to the surface of the aluminum plate, the surface of the aluminum plate was mechanically roughened by means of a rotating roller-like nylon brush. Then, an etching treatment by means of spraying was carried out with a caustic soda concentration of 2.6 wt % and an aluminum ion concentration of 6.5 wt %, at a temperature of 70° C. As a result, the aluminum plate was dissolved in an amount of 6 g/m$^2$, and subjected to water washing by means of spraying. Further, a desmutting treatment was carried out by spraying with an aqueous solution having a nitric acid concentration of 1 wt % at a temperature of 30° C. (containing aluminum ions in an amount of 0.5 wt %), and water washing was carried out by means of spraying. Thereafter, an electrochemical surface roughening treatment was continuously carried out using 60 Hz alternating current. The electrolyte at this step was a 10 g/l aqueous solution of nitric acid (containing aluminum ions in an amount of 5 g/l, and ammonium ions in an amount of 0.007 wt %), and had a temperature of 80° C. After water washing, the aluminum plate was subjected to an etching treatment by means of spraying with a caustic soda concentration of 26 wt %, and an aluminum ion concentration of 6.5 wt % at 32° C. As a result, the aluminum plate was dissolved in an amount of 0.20 g/m$^2$, and subjected to water washing by means of spraying. Thereafter, a desmutting treatment was carried out by spraying with an aqueous solution having a sulfuric acid concentration of 25 wt % at a temperature of 60° C. (containing aluminum ions in an amount of 0.5 wt %), and water washing was carried out by means of spraying.

An anodic oxidation treatment was carried out by means of an anodic oxidation apparatus of a two-stage power supply electrolytic treatment process. As the electrolyte fed to an electrolysis part, sulfuric acid was used. Then, water washing was carried out by means of spraying. The final oxide film amount was 2.7 g/m$^2$.

The aluminum plate subjected to the anodic oxidation treatment was immersed in a 1 wt % aqueous solution of water glass No. 3 at 30° C. for 10 seconds, thereby to perform an alkali metal silicate treatment (silicate treatment). Then, water washing by means of spraying was carried out.

Onto the aluminum plate after the silicate treatment, obtained in the foregoing manner, an undercoating solution of the following composition was applied, followed by drying at 80° C. for 15 seconds, thereby forming an undercoat layer in a dry coating amount of 15 mg/m$^2$. As a result, a support 1 was prepared.

<Undercoating solution composition>

| | |
|---|---|
| The following compound | 0.3 g |
| Methanol | 100 g |
| Water | 1 g |

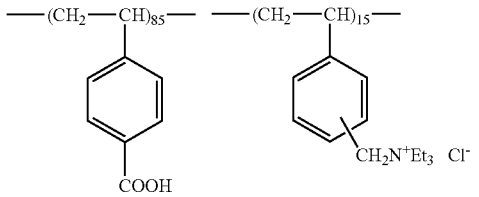

Molecular weight 28,000

(Preparation of Support 2)

The same aluminum plate as that used for preparation of the support 1 was continuously subjected to the following surface treatment.

An electrochemical surface roughening treatment was continuously carried out using 60 Hz alternating current. The electrolyte at this step was a 10 g/l aqueous solution of nitric acid (containing aluminum ions in an amount of 5 g/l, and ammonium ions in an amount of 0.007 wt %), and had a temperature of 80° C. After water washing, the aluminum plate was subjected to an etching treatment by means of spraying with a caustic soda concentration of 26 wt %, and an aluminum ion concentration of 6.5 wt % at 32° C. As a result, the aluminum plate was dissolved in an amount of 0.20 g/m$^2$, and subjected to water washing by means of spraying. Thereafter, a desmutting treatment was carried out by spraying with an aqueous solution having a sulfuric acid concentration of 25 wt % at a temperature of 60° C. (containing aluminum ions in an amount of 0.5 wt %), and water washing was carried out by means of spraying.

The aluminum plate which had undergone the electrochemical surface roughening treatment in the foregoing manner was subjected to the anodic oxidation treatment, the silicate treatment, and the undercoating solution coating in the same manner as with the preparation of the support 1 to prepare a support 2.

(Preparation of Support 3)

A 0.3 mm-thick aluminum plate (material: JISA 1050) was subjected to an etching treatment with a caustic soda concentration of 30 g/l and an aluminum ion concentration of 10 g/l, at a solution temperature of 60° C. for 10 seconds, and washed with running water, washed for neutralization with a 10 g/l nitric acid, and then washed with water. This was subjected to an electrochemical surface roughening treatment in an aqueous solution with a hydrogen chloride concentration of 15 g/l and an aluminum ion concentration of 10 g/l, and a solution temperature of 30° C. using sine wave a.c. waveform current under the condition of applied voltage Va=20 V at a quantity of electricity of 500 C/dm$^2$. After water washing, the plate was subjected to an etching treatment with a caustic soda concentration of 30 g/l and an aluminum ion concentration of 10 g/l, at a solution temperature of 40° C. for 10 seconds, and washed with running water. Then, the plate was subjected to a desmutting treatment in a sulfuric acid aqueous solution having a sulfuric acid concentration of 15 wt % and a temperature of 30° C., and washed with water. Further, the plate was subjected to an anodic oxidation treatment in a 10 wt % sulfuric acid aqueous solution with a temperature of 20° C. under the condition of a current density in direct current of 6 A/dm$^2$ so that the anodic oxide film amount becomes equal to 2.5 g/m$^2$, followed by water washing and drying. Thereafter, the plate was treated in a 2.5 wt % aqueous solution of sodium silicate at 30° C. for 10 seconds, thereby preparing a support. The center line average height (Ra) of the support was measured using a probe with a diameter of 2 μm, and found to be 0.48 μm.

On the silicate-treated aluminum plate obtained in the foregoing manner, the undercoating solution coating (dry coating amount of 17 mg/m$^2$) was performed in the same manner as with the preparation of the support 1, thereby preparing a support 3.

(Preparation of Support 4)

The following treatments (a) to (1) were performed in this order, thereby preparing a support 4.

(a) Mechanical Surface Roughening Treatment

By the use of a 0.3 mm-thick JIS-A-1050 aluminum plate, while feeding a suspension of abrasive (quartz sand) in water, having a specific gravity of 1.12 as an abrasive slurry solution to the surface of the aluminum plate, the surface of the aluminum plate was mechanically roughened by means of a rotating roller-like nylon brush. The abrasive had an average grain size of 8 μm and a maximum grain diameter of 50 μm. The material of the nylon brush was 6·10 nylon. The hair length was 50 mm and the hair diameter was 0.3 mm. In the nylon brush, hairs were implanted densely into holes bored on a 300 mmϕ stainless tube. Three rotary brushes were used. The distance between two supporting rollers (ϕ200 mm) at the lower part of the brushes was 300 mm. The brush rollers were pressed until the load of a driving motor for rotating the brushes reached +7 kw relative to the load before pressing of the brush rollers onto the aluminum plate. The direction of rotation of the brushes was the same as the direction of movement of the aluminum plate. The number of revolutions of the brushes was 200 rpm.

(b) Alkali Etching Treatment

Onto the aluminum plate obtained in the foregoing manner, a NaOH aqueous solution (concentration: 26 wt %, aluminum ion concentration: 6.5 wt %) at a temperature of 70° C. was sprayed, thereby performing an etching treatment. As a result, the aluminum plate was dissolved in an amount of 6 g/m$^2$. Thereafter, water washing by means of spraying was carried out using well water.

(c) Desmutting Treatment

A desmutting treatment was carried out by spraying with an aqueous solution having a nitric acid concentration of 1 wt % at a temperature of 30° C. (containing aluminum ions in an amount of 0.5 wt %), and then, water washing was carried out by means of spraying. As the nitric acid aqueous solution used for the desmutting, the liquid waste of the step of performing electrochemical surface roughening with alternating current in a nitric acid aqueous solution was used.

(d) Electrochemical Surface Roughening Treatment

An electrochemical surface roughening treatment was continuously carried out using 60 Hz alternating current. The electrolyte at this step was a 10.5 g/l aqueous solution of nitric acid (containing aluminum ions in an amount of 5 g/l), and had a temperature of 50° C. For an a.c. power waveform, a trapezoidal square alternating current having a time TP required for current value to reach from zero to peak of 0.8 msec and a duty ratio of 1:1 was used. Thus, an electrochemical surface roughening treatment was carried out with a carbon electrode as a counter electrode. The auxiliary anode used was ferrite. The electrolytic cell used was a radial type cell.

The current density in terms of the current peak value was 30 A/dm$^2$, and the quantity of electricity was 220 C/dm$^2$ in terms of the total sum of the quantity of electricity when the aluminum plate served as an anode. Five percent of the current flown from the power source was diverted into the auxiliary anode.

Thereafter, water washing by means of spraying was carried out using well water.

(e) Alkali Etching Treatment

The aluminum plate was subjected to an etching treatment by means of spraying with a solution having a caustic soda concentration of 26 wt % and an aluminum ion concentration of 6.5 mass % at 32° C. As a result, the aluminum plate was dissolved in an amount of 0.20 g/m$^2$, and the smut component mainly comprising aluminum hydroxide produced upon performing the electrochemical surface roughening using alternating current of the previous stage was removed, and the edge parts of pits produced were dissolved to smooth the edge parts. Thereafter, water washing by means of spraying was carried out using well water.

(f) Desmutting Treatment

A desmutting treatment by means of spraying was carried out with an aqueous solution having a sulfuric acid concentration of 15 wt % at a temperature of 30° C. (containing aluminum ions in an amount of 4.5 wt %), and then, water washing was carried out by means of spraying using well water. As the nitric acid aqueous solution used for the desmutting, the liquid waste of the step of performing electrochemical surface roughening with alternating current in a nitric acid aqueous solution was used.

(g) Electrochemical Surface Roughening Treatment

An electrochemical surface roughening treatment was continuously carried out using 60 Hz alternating current. The electrolyte at this step was a 7.5 g/l aqueous solution of hydrochloric acid (containing aluminum ions in an amount of 5 g/l), and had a temperature of 35° C. The a.c. power waveform used was that of a square wave. Thus, an electrochemical surface roughening treatment was carried out with a carbon electrode as a counter electrode. The auxiliary anode used was ferrite. The electrolytic cell used was a radial type cell.

The current density in terms of the current peak value was 25 A/dm$^2$, and the quantity of electricity was 50 C/dm$^2$ in terms of the total sum of the quantity of electricity when the aluminum plate served as an anode.

Thereafter, water washing by means of spraying was carried out using well water.

(e) Alkali Etching Treatment

The aluminum plate was subjected to an etching treatment by means of spraying with a solution having a caustic soda concentration of 26 wt % and an aluminum ion concentration of 6.5 mass % at 32° C. As a result, the aluminum plate was dissolved in an amount of 0.10 g/m$^2$, and the smut component mainly comprising aluminum hydroxide produced upon performing the electrochemical surface roughening using alternating current in the previous stage was removed, and the edge parts of pits produced were dissolved to smooth the edge parts. Thereafter, water washing by means of spraying was carried out using well water.

(f) Desmutting Treatment

A desmutting treatment by means of spraying was carried out with an aqueous solution having a sulfuric acid concentration of 25 wt % at a temperature of 60° C. (containing aluminum ions in an amount of 0.5 wt %), and then, water washing was carried out by means of spraying using well water.

(j) Anodic Oxidation Treatment

The electrolyte used was sulfuric acid. Either electrolyte had a sulfuric acid concentration of 170 g/l (containing aluminum ions in an amount of 0.5 wt %), and had a temperature of 43° C. Thereafter, water washing by means of spraying was carried out using well water.

Either current density was about 30 A/dm$^2$. The final oxide film amount was 2.7 g/m$^2$.

(k) Silicate Treatment

A silicate treatment was carried out in the same manner as with the preparation of the support 1. The amount of silicate deposited was 3.5 mg/m$^2$.

(1) Formation of Undercoat

The coating of an undercoating solution was carried out in the same manner as with the preparation of the support 1. The coating amount after drying was 15 mg/m$^2$.

Examples 1 to 37 and Comparative Examples 1 to 3

[Preparation of Photosensitive Lithographic Printing Plate]

(Photosensitive Lithographic Printing Plate A)

Onto each support obtained in the foregoing manner, the lower heat-sensitive layer coating solution 1 described below was coated. Then, it was dried at 130° C. for 50 seconds in PERFECT OVEN PH200 manufactured by TABAI Co., with Wind Control being set at 7, thereby providing a lower layer in a dry coating amount of 0.85 g/m$^2$. Then, an upper heat-sensitive layer coating solution 1 was coated thereon so that the dry coating amount is 0.25 g/m$^2$. The drying conditions were: 140° C. and 1 minute.

Incidentally, the kind of each copolymer having the monomer unit of the formula (I) to be used in accordance with Examples 1 to 37, and Comparative Examples 1 to 3, and the amount of the copolymer to be added to the coating solution are shown in FIG. 1.

| (Lower heat-sensitive layer coating solution) | |
|---|---|
| N-(4-aminosulfonylphenyl)methacrylamide/ acrylonitrile/methyl methacrylate (36/34/30 wt %: weight-average molecular weight 50000, acid value 2.65) | 2.133 g |
| Cyanine dye A (the following structure) | 0.109 g |
| 4,4'-Bishydroxyphenylsulfone | 0.126 g |
| Cis-$\Delta^4$-tetrahydrophthalic anhydride | 0.190 g |
| P-toluenesulfonic acid | 0.008 g |
| 3-Methoxy-4-diazodiphenylamine hexafluorophosphate | 0.030 g |
| The one prepared by changing the counter ion of Ethyl Violet to 6-hydroxy-2-naphthalene sulfonate | 0.100 g |
| MEGAFAC F176 (manufactured by DAINIPPON INK AND CHEMICALS, INCORPORATED, coating surface condition improving fluorine-containing surfactant) | 0.035 g |
| Methyl Ethyl Ketone | 25.38 g |
| 1-methoxy-2-propanol | 13.0 g |
| γ-butyrolactone | 13.2 g |

Cyanine dye A:

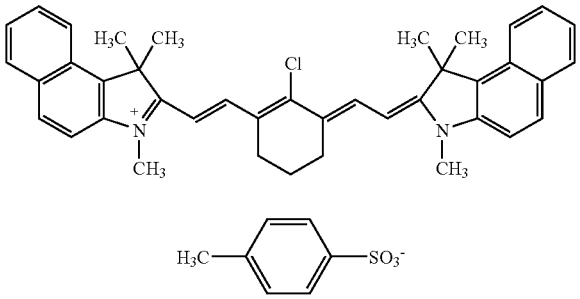

| (Upper heat-sensitive layer coating solution 1) | |
|---|---|
| m-, p-cresol novolak (m/p ratio = 6/4, weight-average molecular weight 4500, containing unreacted cresol in an amount of 0.8 wt %) | 0.3478 g |
| Copolymer of the invention (the kind and content thereof are described in Table 1) | |

-continued

| (Upper heat-sensitive layer coating solution 1) | |
|---|---|
| Cyanine dye A | 0.0192 g |
| Anunonium compound of the following structure | 0.0115 g |

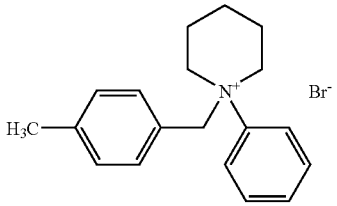

| | |
|---|---|
| MEGAFAC F176 (20%) (manufactured by DAINIPPON INK AND CHEMICALS, INCORPORATED, coating surface condition improving fluorine-containing surfactant) | 0.022 g |
| 1-Methoxy-2-propanol | 13.07 g |
| Methyl Ethyl Ketone | 6.79 g |

Incidentally, for Comparative Examples, each methacrylic acid/methyl methacrylate copolymer shown in Table 1 was used in place of each copolymer of the invention.

(Photosensitive Lithographic Printing Plate B)

Onto each support obtained in the foregoing manner, the following photosensitive layer coating solution 2 was coated so that the dry coating amount was 1.0 g/m$^2$. Drying was carried out at 140° C. for 50 seconds in PERFECT OVEN PH200 manufactured by TABAI Co., with Wind Control being set at 7.

| (Photosensitive layer coating solution 2) | |
|---|---|
| m-, p-cresol novolak (m/p ratio = 6/4, weight-average molecular weight 5000, containing unreacted cresol in an amount of 0.8 wt %) | 0.474 g |
| N-(4-aminosulfonylphenyl)methacrylamide/ acrylonitrile/methyl methacrylate (36/34/30 wt %: weight-average molecular weight 50000, acid value 2.65) | 2.37 g |
| Copolymer of the invention (Table 1) | |
| Cyanine dye A (the structure described above) | 0.155 g |
| 2-Methoxy-4-(N-phenylamino)benzenediazonium hexafluorophosphate | 0.03 g |
| tetrahydrophthalic anhydride | 0.19 g |
| The one prepared by changing the counter ion of Ethyl Violet to 6-hydroxy-β-naphthalene sulfonate | 0.11 g |
| Fluorine-containing surfactant (MEGAFAC F176, manufactured by DAINIPPON INK AND CHEMICALS, INCORPORATED) | 0.02 g |
| Fluorine-containing surfactant (DEFENSA MCF-312, manufactured by DAINIPPON INK AND CHEMICALS, INCORPORATED) | 0.05 g |
| Para-toluenesulfonic acid | 0.008 g |
| Bis-p-hydroxyphenylsulfone | 0.13 g |
| 3,3'-dimyristyl thiodipropionate | 0.04 g |
| Lauryl stearate | 0.02 g |
| γ-butyrolactone | 13 g |
| Methyl Ethyl Ketone | 24 g |
| 1-methoxy-2-propanol | 11 g |

[Evaluation of Development Latitude]

Onto each planographic printing master plate thus obtained, a test pattern was drawn imagewise at abeam intensity of 9 w and a drum rotating speed of 150 rpm by means of Trendsetter manufactured by CREO Co., Ltd. Then, one part by volume of a developer DT-2R manufactured by Fuji Photo Film Co., Ltd., was diluted with 5 parts by volume of water, resulting in a solution (hereinafter, the resulting solution is abbreviated as "the one diluted in 1:5"). Then, a carbonic acid gas was blown into the solution until the electric conductivity became 37 mS/cm to prepare a solution. Using PS Processor LP940H manufactured by Fuji Photo Film Co., Ltd., charged with the solution thus obtained, and Finisher FG-1 (the one diluted in 1:1) manufactured by Fuji Photo Film Co., Ltd., development was carried out with the solution temperature kept at 30° C. for a development time of 12 seconds. Then, a proper amount of DT-2R (the one diluted in 1:5) was added to the developer, so that the electric conductivity was controlled to 39 mS/cm. The planographic printing master plate onto which a test pattern had been drawn imagewise in the same manner as the previous step was developed. Further, the electric conductivity was increased in increments of 2 mS/cm, and this operation was continued until the film reduction due to the development of an image was remarkably observed.

At this step, the plate developed at each electric conductivity was examined for the presence of stains or coloration caused by the non-image portion residual film due to insufficient development. As a result, the electric conductivity of the developer at which it was possible to carry out favorable development was determined. Then, the critical electric conductivity at which development film reduction was kept in such a degree as not to substantially affect the plate wear was determined.

The range between the electric conductivity of the developer at which it was possible to carry out development favorably and the critical electric conductivity at which development film reduction was kept in such a degree as not to substantially affect the plate wear was taken as development latitude.

Further, the same evaluation was carried out using a developer of the following composition in place of DT-2R (the one diluted in 1:5).

| (Alkali developer B composition) | |
|---|---|
| $SiO_2.K_2O$ ($K_2O/SiO_2$ = 1/1 (molar ratio)) | 3.8 wt % |
| citric acid | 0.5 wt % |
| Water | 95.7 wt % |

[Scratch Resistance Evaluation]

With the resulting planographic printing master plates of the invention, each plate was scratched by means of a scratch tester manufactured by HEIDON Corp., with sapphire (tip diameter 1.0 mm) under a load. Immediately thereafter, using PS Processor LP940H manufactured by Fuji Photo Film Co., Ltd., charged with Developer DT-2 (the one diluted in 1:8) manufactured by Fuji Photo Film Co., Ltd., and Finisher FG-1 (the one diluted in 1:1) manufactured by Fuji Photo Film Co., Ltd., development was carried out with the solution temperature kept at 30° C. for a development time of 12 seconds. The electric conductivity at this step was 43 mS/cm. The load under which a scratch became unobservable was taken as the value of scratch resistance. The plate with a larger value is evaluated to be more excellent in scratch resistance.

TABLE 1

| | | | Copolymer of Invention | | | | | | | | | Development Latitude | | |
|---|---|---|---|---|---|---|---|---|---|---|---|---|---|---|
| | S | PPP | Amount | M-A | mol % | M-B | mol % | M-C | Mol % | M-D | mol % | M.W. | DT-2R | D-B | SR |
| E-1 | 1 | A | 0.10 g | a-1 | 17 | b-11 | 83 | — | | — | | 55000 | 8 mS/cm | 10 mS/cm | 15 g |
| E-2 | 2 | A | 0.10 g | a-1 | 20 | b-14 | 80 | — | | — | | 55000 | 9 mS/cm | 8 mS/cm | 20 g |
| E-3 | 3 | A | 0.10 g | a-1 | 25 | b-14 | 75 | — | | — | | 55000 | 8 mS/cm | 12 mS/cm | 20 g |
| E-4 | 4 | A | 0.10 g | a-3 | 28 | b-14 | 72 | — | | — | | 55000 | 8 mS/cm | 14 mS/cm | 25 g |
| E-5 | 4 | B | 0.10 g | a-5 | 16 | b-3 | 84 | — | | — | | 50000 | 10 mS/cm | 12 mS/cm | 20 g |
| E-6 | 3 | B | 0.10 g | a-6 | 23 | b-3 | 77 | — | | — | | 50000 | 9 mS/cm | 14 mS/cm | 15 g |
| E-7 | 1 | A | 0.05 g | a-1 | 26 | — | | c-3 | 74 | — | | 50000 | 12 mS/cm | 14 mS/cm | 25 g |
| E-8 | 4 | B | 0.10 g | a-1 | 24 | — | | c-4 | 76 | — | | 48000 | 8 mS/cm | 10 mS/cm | 20 g |
| E-9 | 3 | A | 0.10 g | a-3 | 26 | — | | c-5 | 74 | — | | 48000 | 8 mS/cm | 8 mS/cm | 20 g |
| E-10 | 4 | A | 0.10 g | a-5 | 28 | — | | c-9 | 72 | — | | 29000 | 9 mS/cm | 9 mS/cm | 18 g |
| E-11 | 4 | B | 0.06 g | a-8 | 37 | — | | c-10 | 63 | — | | 29000 | 10 mS/cm | 12 mS/cm | 20 g |
| E-12 | 4 | B | 0.06 g | a-8 | 11 | — | | c-10 | 89 | — | | 35000 | 12 mS/cm | 14 mS/cm | 25 g |
| E-13 | 4 | B | 0.06 g | a-1 | 6 | b-1 | 42 | c-1 | 52 | — | | 31000 | 14 mS/cm | 8 mS/cm | 20 g |
| E-14 | 4 | B | 0.06 g | a-1 | 23 | b-1 | 32 | c-1 | 45 | — | | 33000 | 8 mS/cm | 10 mS/cm | 18 g |
| E-15 | 4 | A | 0.10 g | a-3 | 34 | b-7 | 51 | c-1 | 15 | — | | 40000 | 9 mS/cm | 12 mS/cm | 20 g |
| E-16 | 4 | A | 0.10 g | a-5 | 6 | b-7 | 42 | c-2 | 52 | — | | 50000 | 8 mS/cm | 11 mS/cm | 20 g |
| E-17 | 4 | A | 0.10 g | a-6 | 9 | b-4 | 21 | c-2 | 50 | d-1 | 20 | 48000 | 7 mS/cm | 9 mS/cm | 15 g |
| E-18 | 4 | A | 0.10 g | a-8 | 25 | b-5 | 10 | c-2 | 30 | d-2 | 35 | 40000 | 10 mS/cm | 10 mS/cm | 20 g |
| E-19 | 4 | B | 0.10 g | a-8 | 23 | b-9 | 37 | c-2 | 25 | d-3 | 15 | 30000 | 12 mS/cm | 8 mS/cm | 20 g |
| E-20 | 4 | B | 0.10 g | a-12 | 30 | b-10 | 70 | — | | — | | 45000 | 10 mS/cm | 9 mS/cm | 20 g |
| E-21 | 4 | B | 0.10 g | a-12 | 28 | b-10 | 72 | — | | — | | 50000 | 8 mS/cm | 10 mS/cm | 20 g |
| E-22 | 4 | B | 0.10 g | a-14 | 33 | b-14 | 67 | — | | — | | 40000 | 8 mS/cm | 12 mS/cm | 15 g |
| E-23 | 4 | B | 0.10 g | a-17 | 28 | — | 0 | c-1 | 72 | — | | 30000 | 9 mS/cm | 10 mS/cm | 20 g |
| E-24 | 4 | A | 0.20 g | a-18 | 32 | — | 0 | c-3 | 68 | — | | 30000 | 9 mS/cm | 10 mS/cm | 25 g |
| E-25 | 4 | A | 0.30 g | a-20 | 33 | — | 0 | c-10 | 67 | — | | 30000 | 8 mS/cm | 10 mS/cm | 20 g |
| E-26 | 4 | A | 0.40 g | a-21 | 29 | b-10 | 51 | c-1 | 20 | — | | 30000 | 10 mS/cm | 8 mS/cm | 20 g |
| E-27 | 4 | A | 0.10 g | a-22 | 24 | b-16 | 39 | c-3 | 37 | — | | 30000 | 12 mS/cm | 9 mS/cm | 18 g |
| E-28 | 4 | A | 0.10 g | a-22 | 18 | b-3 | 30 | c-6 | 52 | — | | 30000 | 8 mS/cm | 11 mS/cm | 20 g |
| E-29 | 4 | B | 0.10 g | a-24 | 4 | b-3 | 21 | c-10 | 75 | — | | 30000 | 8 mS/cm | 10 mS/cm | 18 g |
| E-30 | 4 | B | 0.10 g | a-24 | 11 | b-3 | 7 | c-10 | 62 | d-1 | 20 | 30000 | 9 mS/cm | 11 mS/cm | 20 g |
| E-31 | 4 | B | 0.10 g | a-30 | 19 | b-3 | 3 | c-6 | 44 | d-2 | 34 | 30000 | 9 mS/cm | 10 mS/cm | 20 g |
| E-32 | 4 | A | 0.10 g | a-33 | 27 | b-16 | 36 | c-6 | 20 | d-3 | 17 | 30000 | 10 mS/cm | 12 mS/cm | 15 g |
| E-33 | 4 | B | 0.10 g | a-29 | 32 | — | | — | | d-3 | 68 | 30000 | 12 mS/cm | 9 mS/cm | 20 g |

TABLE 1-continued

| | | | Copolymer of Invention | | | | | | | | Development Latitude | | |
|---|---|---|---|---|---|---|---|---|---|---|---|---|---|
| | S | PPP | Amount M-A | mol % | M-B | mol % | M-C | Mol % | M-D | mol % | M.W. | DT-2R | D-B | SR |
| E-34 | 4 | A | 0.10 g a-29 | 36 | — | | — | | d-4 | 64 | 30000 | 10 mS/cm | 8 mS/cm | 20 g |
| E-35 | 4 | A | 0.10 g a-34 | 32 | — | | — | | d-4 | 68 | 30000 | 8 mS/cm | 10 mS/cm | 20 g |
| E-36 | 4 | B | 0.10 g a-35 | 29 | — | | — | | d-5 | 71 | 30000 | 9 mS/cm | 10 mS/cm | 20 g |
| E-37 | 4 | B | 0.45 g a-36 | 31 | — | | — | | d-5 | 69 | 30000 | 8 mS/cm | 12 mS/cm | 18 g |
| CE-1 | 4 | B | 0.60 g MA | 24 | — | | — | | d-2 | 76 | 55000 | 2 mS/cm | 3 mS/cm | 2 g |
| CE-2 | 4 | B | 0.10 g MA | 22 | — | | — | | d-2 | 78 | 58000 | 2 mS/cm | 2 mS/cm | 4 g |
| CE-3 | 4 | B | 0.10 g MA | 36 | — | | — | | d-2 | 64 | 53000 | 2 mS/cm | 2 mS/cm | 3 g |

Note:
E; Example,
CE; Comparative Example,
S; Support,
PPP; Photosensitive Printing Plate,
M-A; Monomer A,
M-B; Monomer B,
M-C; Monomer C,
M-D; Monomer D,
M.W.: Molecular Weight,
D-B; Developer B,
SR; Scratch Resistance,
MA; Methacrylic Acid.

The copolymerizable monomers used for the copolymers of the invention described in Table 1 are shown below.

Monomer a: Monomer Represented by the Formula (I)
Exemplified compounds a-1 to a-36

Monomer b: Styrene Derivative
Exemplified compounds b-1 to b-17

Monomer c: Acrylamide Derivative
Exemplified compounds c-1 to c-10

Monomer d: Acrylic Acid Ester
d-1: methyl acrylate
d-2: methyl methacrylate
d-3: ethyl methacrylate
d-4: isopropyl methacrylate
d-5: n-butyl methacrylate As apparent from Table 1, in Examples 1 to 37 of the invention, the development latitude is largely extended, and the scratch resistance is also remarkably improved as compared with Comparative Examples 1 to 3.

In accordance with the invention, direct plate-making is possible based on digital data from a computer or the like, and it is possible to provide an infrared-sensitive lithographic printing plate excellent in development latitude and scratch resistance.

This application is based on Japanese patent application JP 2002-382230, filed on Dec. 27, 2002, the entire content of which is hereby incorporated by reference, the same as if set forth at length.

a-29

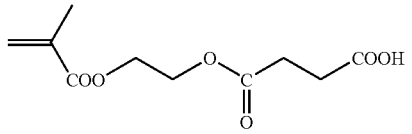

a-33

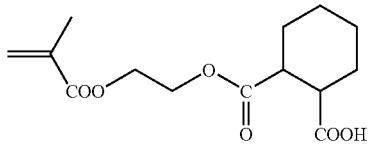

a-34

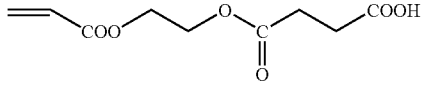

a-35

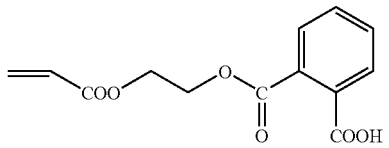

a-36

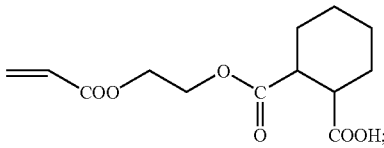

What is claimed is:

1. An infrared-sensitive lithographic printing plate comprising a support and a heat-sensitive layer, wherein the heat-sensitive layer comprises:

(A) a copolymer having a monomer unit selected from the group consisting of monomer units represented by the following formulas, a-29, a-33, a-34, a-35 and a-36, and at least one monomer unit selected from the group consisting of (meth)acrylic acid esters and (meth)acrylamide derivatives:

(B) an alkali-soluble high molecular weight compound having a sulfonamide group; and (C) a light-heat conversion material, provided that the copolymer (A) and the compound (B) are separate and distinct components.

2. The infrared-sensitive lithographic printing plate according to claim 1, wherein the copolymer (A) comprises the monomer unit selected from the group consisting of monomer units represented by formulas, a-29, a-33, a-34, a-35 and a-36 in an amount of 1 to 90 mol%.

3. The infrared-sensitive lithographic printing plate according to claim 1, wherein the copolymer (A) further has at least one monomer unit which is a styrene derivative.

4. The infrared-sensitive lithographic printing plate according to claim 3, wherein the amount of the styrene derivative monomer unit is from 5 to 90 mol %.

5. The infrared-sensitive lithographic printing plate according to claim 1, wherein the amount of the at least one monomer unit selected from the group consisting of(meth) acrylic acid esters and (meth)acrylamide derivatives is from 5 to 90 mol%.

6. The infrared-sensitive lithographic printing plate according to claim 1, wherein the heat-sensitive layer comprises the copolymer (A) in an amount of 1 wt % to 40 wt %.

7. The infrared-sensitive lithographic printing plate according to claim 1, wherein the alkali-soluble high molecular weight compound (B) has at least one monomer unit of low molecular weight compounds each having in one molecule, at least one sulfonamide group —NH—$SO_2$— and at least one polymerizable unsaturated bond.

8. The infrared-sensitive lithographic printing plate according to claim 1, wherein the heat-sensitive layer further comprises a novolak resin.

9. The infrared-sensitive lithographic printing plate according to claim 1, wherein the light-heat conversion material is an infrared absorbing dye.

10. The infrared-sensitive lithographic printing plate according to claim 9, wherein the infrared absorbing dye has an absorbance at 700 to 1200 nm infrared rays.

11. The infrared-sensitive lithographic printing plate according to claim 1, wherein the heat-sensitive layer comprises the light-heat conversion material in an amount of 0.01 to 50 wt %.

* * * * *